US006779470B2

(12) United States Patent
Sakakibara et al.

(10) Patent No.: US 6,779,470 B2
(45) Date of Patent: Aug. 24, 2004

(54) SEWING APPARATUS AND NEEDLE BAR POSITION CONTROL PROGRAM THEREFOR

(75) Inventors: Kaoru Sakakibara, Aichi (JP); Akira Kaiya, Aichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/614,081

(22) Filed: Jul. 8, 2003

(65) Prior Publication Data

US 2004/0103833 A1 Jun. 3, 2004

(30) Foreign Application Priority Data

Jul. 10, 2002 (JP) ..... 2002-201209

(51) Int. Cl.[7] ..... D05B 19/14

(52) U.S. Cl. ..... 112/470.01; 112/225; 112/275; 112/456

(58) Field of Search ..... 112/470.01, 225, 112/275, 456, 453, 443, 457, 458, 270, 302, 254, 255, 459, 460

(56) References Cited

U.S. PATENT DOCUMENTS 6,641,598 B2 * 11/2003 Shimizu et al. ..... 112/302
6,694,904 B2 * 2/2004 Mamiya ..... 112/302

FOREIGN PATENT DOCUMENTS

JP 2002-91558 3/2002

* cited by examiner

*Primary Examiner*—Peter Nerbun
(74) *Attorney, Agent, or Firm*—Oliff & Berridge, PLC

(57) ABSTRACT

A sewing apparatus such as sewing machine includes a needle bar, a needle bar rocking mechanism for rocking the needle bar, a thread cassette having a thread accommodating section for accommodating a thread, a cassette mount to which the thread cassette is detachably attached, a threading mechanism for passing the thread drawn from the thread cassette through a hole of a sewing needle mounted on the needle bard, a detector for detecting the thread cassette ejected from the cassette mount, and a needle bar position control unit controlling the needle bar rocking mechanism so that the needle bar is rocked so as to occupy a predetermined zigzag position, when the detector has detected the thread cassette ejected from the cassette mount.

10 Claims, 20 Drawing Sheets

SEWING APPARATUS AND NEEDLE BAR POSITION CONTROL PROGRAM THEREFOR

BACKGROUND OF THE INVENTION

1. Field of the Invention

This invention relates to a sewing apparatus including a cassette mount to which a thread cassette is detachably attached and a threading mechanism automatically passing a thread through a needle hole, and a needle bar position control program for such a sewing apparatus.

2. Description of the Invention

Sewing apparatus have conventionally been provided including a cassette mount to which a thread cassette is detachably attached. The thread cassette accommodates a thread spool on which a thread is wound. The thread drawn from the thread cassette serves as a needle thread. The thread drawn from the thread cassette attached to the cassette mount is caused to extend between a pair of thread tension discs and then caught by a needle thread take-up lever. The thread is further caused to pass through a hole of a sewing needle mounted to a needle bar, thereby being set. The assignee of the present application filed a Japanese patent application to which application No. 2002-91558 has been assigned. This Japanese patent application discloses a sewing apparatus including a thread feeding mechanism operated in synchronization with attachment of the thread cassette to the cassette mount, and a threading mechanism. The thread drawn from the thread cassette is automatically passed through the needle hole by the thread feeding mechanism and threading mechanism.

In the foregoing sewing apparatus, the thread feeding mechanism includes a thread catching member and a moving mechanism for moving the thread catching member. Upon actuation of the thread feeding mechanism, the thread catching member is lowered so that the thread drawn from the thread cassette is caught by the thread catching member. The thread is carried near the needle hole and then tensioned in front of the needle hole. The threading mechanism comprises a threading shaft provided along the needle bar so as to be moved up and down and further rotated and a threading hook mounted on a lower end of the threading shaft so as to be allowed to pass through the needle hole. Upon actuation of the threading mechanism, the threading shaft is lowered to be Positioned relative to the needle bar and then stopped. Successively, the threading shaft is rotated so that the threading hook is passed through the needle hole. The thread drawn from the thread cassette has been carried near the needle hole by the thread catching member. The thread is caught by the threading hook having been passed through the needle hole and subsequently, the threading shaft is rotated in the reverse direction so as to be pulled out of the needle hole.

In the sewing apparatus of the above-described type, the needle bar is rocked right and left relative to an arm portion of the sewing apparatus by a needle bar rocking mechanism, so that zigzag stitches and the like are realized. In this case, the needle bar and the threading mechanism are supported on a needle bar frame pivotally mounted on a frame of the arm, so that the needle bar is stopped at any zigzag position when the sewing machine is stopped. On the other hand, the aforesaid thread feeding mechanism is mounted on the frame of the arm, and the thread drawn from the thread cassette is carried to a fixed position relative to the arm.

Accordingly, when the thread cassette has been attached to the cassette mount, a difference is sometimes caused between a position of the thread carried by the thread feeding mechanism and a position of the needle hole, depending upon a zigzag position of the needle bar. Consequently, the threading cannot be carried out sufficiently since the thread carried by the thread feeding mechanism is not caught by the threading hook of the threading mechanism. In this regard, the user may manually locate the needle bar at a predetermined zigzag position when the thread cassette is attached to the cassette mount. However, the user is forced into troublesome operation.

SUMMARY OF THE INVENTION

Therefore, an object of the present invention is to provide a sewing apparatus in which the thread drawn from the thread cassette attached to the cassette mount can be passed through the needle hole by the threading mechanism easily and reliably and a needle bar position control program which can be applied to the sewing apparatus.

The present invention provides a sewing apparatus comprising a needle bar, a needle bar rocking mechanism for rocking the needle bar, a thread cassette having a thread accommodating section for accommodating a thread, a cassette mount to which the thread cassette is detachably attached, a threading mechanism for passing the thread drawn from the thread cassette through a hole of a sewing needle mounted on the needle bard a detector for detecting the thread cassette ejected from the cassette mount, and a needle bar position control unit controlling the needle bar rocking mechanism so that the needle bar is rocked so as to occupy a predetermined zigzag position, when the detector has detected the thread cassette ejected from the cassette mount.

In the above-described construction, the needle bar rocking mechanism is controlled by the needle bar position control unit on the basis of detection by the detector when the thread cassette has been ejected from the cassette mount, so that the needle bar is rocked into the predetermined zigzag position where the thread can be passed through the needle eye by the threading mechanism. Thus, when a cassette is to be attached to the cassette mount at a next occasion, the needle bar is located at the predetermined zigzag position where the thread can be passed through the needle eye by the threading mechanism. Accordingly, when the thread cassette has been ejected from the cassette mount, an operation for subsequent attachment of the thread cassette can be automatically carried out without the user being forced into troublesome operation. Consequently, the thread drawn from the thread cassette attached to the cassette mount can be passed through the needle eye by the threading mechanism easily and reliably.

As the aforesaid detector, limit switches or the like may be provided so as to be turned on and off in response to attachment and detachment of the thread cassette to and from the cassette mount, whereupon ejection of the thread cassette is detected directly by the limit switch. Furthermore, when an operating member is provided so as to be operated when the thread cassette is ejected from the cassette mount, operation of the operating member may be detected by a switch or the like, whereby ejection of the thread cassette may be detected indirectly.

The foregoing sewing apparatus may further comprise a thread feeding mechanism catching the thread drawn from the thread cassette and carrying the thread near the needle hole when the thread cassette has been attached to the cassette mount. The thread carried by the thread feeding mechanism may be passed through the needle hole by the threading mechanism. In this case, the predetermined zigzag position of the needle bar can be set so as to correspond to the location of the thread feeding mechanism.

In the above-described construction, the thread carried near the needle hole of the sewing needle by the thread feeding mechanism is passed through the needle hole. Since the predetermined zigzag position of the needle bar can be set so as to correspond to the location of the thread feeding mechanism, the needle bar (needle), a suitable constant positional relationship can usually be maintained Consequently, the threading operation can reliably be carried out.

U.S. patent application No. Ser. 10/392,186 discloses the structure of the threading mechanism of the above-noted type in detail.

The sewing apparatus may further comprise a needle bar up-down movement mechanism moving the needle bar up and down and a needle bar up-down movement stopping unit stopping the needle bar up-down movement mechanism when ejection of the thread cassette from the cassette mount is detected during operation of the needle bar up-down movement mechanism.

In the above-described construction, the up-down movement of the needle bar is stopped by the needle bar up-down movement stopping unit when the thread cassette has been ejected from the cassette mount during operation of the needle bar up-down movement mechanism. Consequently, any trouble due to continuous up-down movement of the needle bar even after ejection of the thread cassette can be prevented. Furthermore, the needle bar can be re-rocked to the predetermined zigzag position for the subsequent attachment of the thread cassette after the needle bar has been stopped.

The sewing apparatus may further comprise a thread tensioning unit adjusting a tension of the thread drawn from the thread cassette attached to the cassette mount and a thread tension control unit controlling the thread tensioning unit so that the thread tensioning unit is opened when ejection of the thread cassette from the cassette mount is detected by the detector during operation of the needle bar up-down movement mechanism.

In the above-described construction, the thread drawn from the thread cassette is reliably released from the thread tensioning unit by the thread tension control unit when the thread cassette is ejected from the cassette mount. Consequently, the thread cassette can be ejected from the cassette mount smoothly without the thread being caught by the thread tensioning unit.

The detector may further detect the thread cassette having been attached to the cassette mount, and the needle bar position control unit may control the needle bar rocking mechanism so that the needle bar is rocked so as to occupy a sewing start Position; a predetermined period of time after attachment of the thread cassette to the cassette mount is detected by the detector.

In the above-described construction, when the thread cassette has been attached to the cassette mount, the needle bar rocking mechanism is controlled by the needle bar position control unit the predetermined period of time after the attachment so that the needle bar is rocked from a predetermined needle rock position to a sewing start position. Consequently, the sewing operation can be started quickly.

In this case, the aforesaid predetermined period of time is desirable to be as short as possible although it needs to be sufficiently long enough to carry out the threading operation by the threading mechanist. According to the study by the inventors, the predetermined period of time is 30 msec.

Furthermore, both the needle bar rocking mechanism and the thread tensioning unit are preferably driven by a single pulse motor. Consequently, the construction of the sewing apparatus can be simplified as compared with the case where two drive sources are provided for the needle bar rocking mechanism and the thread tensioning unit respectively.

The aforesaid needle bar up-down movement mechanism is driven by the spindle further driven by the sewing machine motor. Where an angle of the spindle is 0 (or 360 degrees) when the needle bar (sewing needle) is at an uppermost position, the needle bar is located at a position of height corresponding to a rotation angle of the spindle. The sewing apparatus provided with the aforesaid needle bar up-down movement stopping unit may further comprise a spindle driving the needle bar up-down movement mechanism and a spindle rotation angle detector detecting a rotation angle of the spindle. The needle bar up-down movement stopping unit may stop the needle bar up-down movement mechanism within a Predetermined range of rotation angle so that the needle thread is stopped at a vertical position where the thread can be passed through the needle hole by the threading mechanism, based on a result of detection by the spindle rotation angle detecting unit.

In the above-described construction, when the up-down movement of the needle bar is stopped by the needle bar up-down movement stopping unit, the needle bar is stopped at the vertical position where the thread can be passed through the needle hole by the threading mechanism. Accordingly, when the thread cassette is subsequently attached to the cassette mount, the needle bar is located at the position where the thread can be passed through the needle hole by the threading mechanism. Consequently, the thread drawn from the thread cassette attached to the cassette mount can be passed through the needle hole by the threading mechanism easily and reliably. In this regard, the research by the inventors reveals that the predetermined range of rotation angle is preferably from 20 to 50 degrees.

The invention further provides a needle bar position control program for controlling a position of a needle bar in a sewing apparatus including a needle bar, a needle bar rocking mechanism for rocking the needle bar, a thread cassette having a thread accommodating section for accommodating a thread, a cassette mount to which the thread cassette is detachably attached, a threading mechanism for passing the thread drawn from the thread cassette through a hole of a sewing needle mounted on the needle bar, and a detector for detecting the thread cassette ejected from the cassette mount, the program accomplishing a function of controlling the needle bar rocking mechanism so that the needle bar is rocked so as to occupy a predetermined zigzag position, when the detector has detected the thread cassette ejected from the cassette mount.

The needle bar position control program is applied to a computer provided in the sewing apparatus. In the sewing apparatus, the needle bar rocking mechanism is controlled on the basis of the results of detection by the detector when the thread cassette has been detached from the cassette mount, whereupon the needle bar is rocked to a predetermined zigzag position where the thread can be passed through the needle hole by the threading mechanism. The needle bar position control program may be supplied to users via communication means such as the internet or the like, or may be recorded on a recording medium such as CD, MD or FD to be supplied to the user with the recording medium.

BRIEF DESCRIPTION OF THE DRAWINGS

Other objects, features and advantages of the present invention will become clear upon reviewing the following description of embodiments, made with reference to the accompanying drawings, in which.

DETAILED DESCRIPTION OF THE INVENTION

Figure 1:
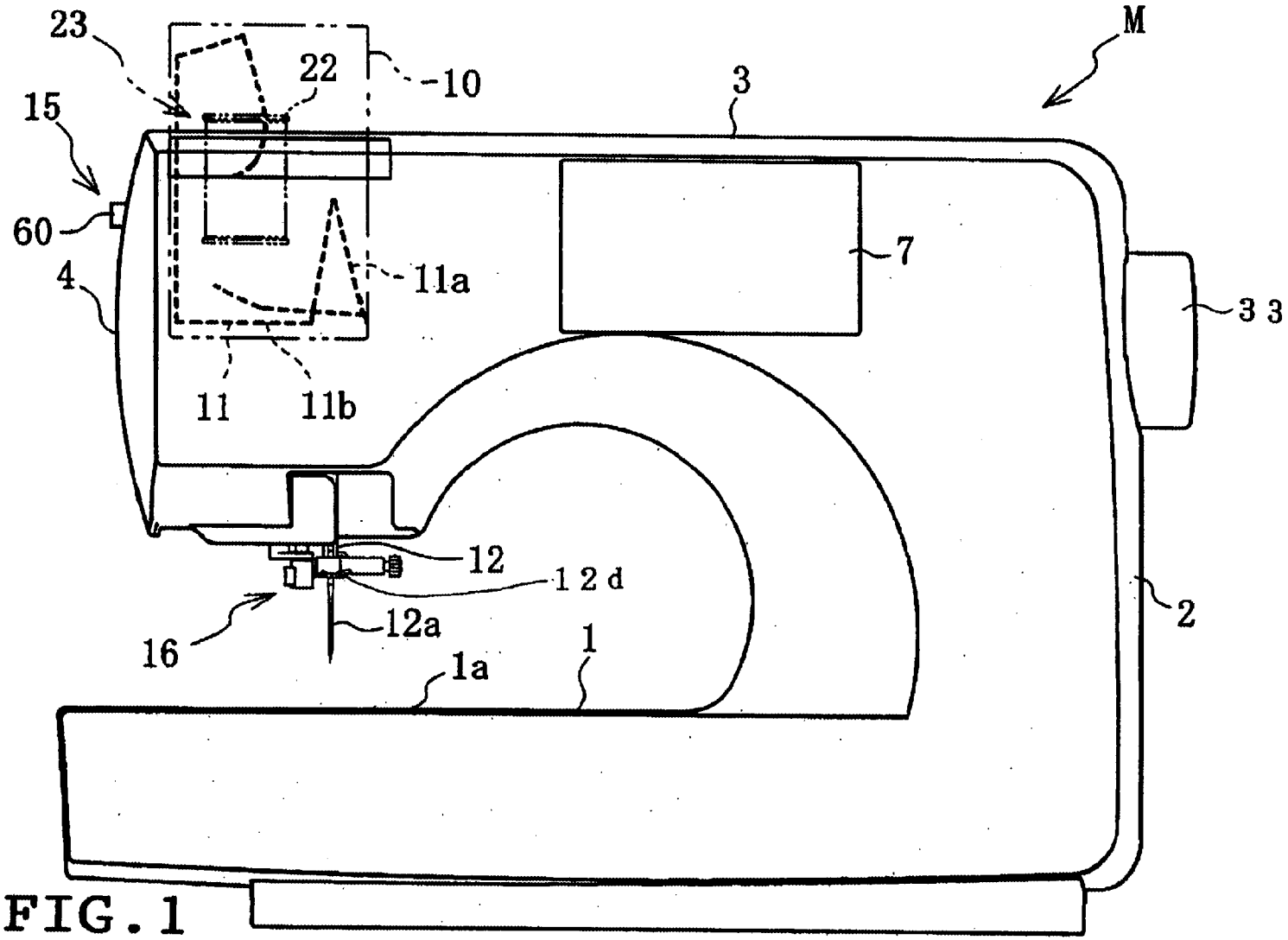
FIG. 1 is a front view of a sewing machine in accordance with one embodiment of the present invention, showing the condition where the thread cassette is being attached.

One embodiment of the present invention will be described with reference to the accompanying drawings. In the embodiment, the invention is applied to a household sewing machine with a cassette mount to which a thread cassette having a thread accommodating section for accommodating a thread supply is detachably attached.

Referring to FIGS. 1 to 4, the household sewing machine M includes a sewing bed 1 having a horizontal plane, a pillar 2 standing from a right end of the bed 1, a sewing arm 3 extending leftward from an upper end of the pillar 2 so as to be opposed along the bed 1 and a machine head 4 located at a left end of the arm 3. The head 4 is provided with a cassette mount 5 to which a thread cassette 10 is detachably attached. A thread 11 drawn from the thread cassette 10 attached to the cassette mount 5 serves as a needle thread. The arm 3 or the head 4 thereof includes operation switches 6 (only shown in FIG. 17) such as a sewing start switch, a sewing finish switch, etc. The arm 3 further includes a liquid crystal display 7. A touch panel 8 (see FIG. 17) is provided on the surface of the display 7.

Referring to FIGS. 2, 4, 9 and 10, in the head 4 are provided a needle bar 12 having a lower end to which a sewing needle 12*a* is mounted, a needle thread take-up 13 moved up and down in synchronization with the need bar so that the thread is tensioned, a thread tensioning mechanism 14 adjusting a tension of the thread 11 drawn from the thread cassette 10 attached to the cassette mount 5. In the head 14 are further provided a thread tension releasing mechanism 15 rendering the thread tensioning mechanism 14 open when an ejection operating member 60 is operated, a thread feeding mechanism 16A, threading mechanism 16B and thread guiding mechanism 17 each operated in synchronization with a cassette attaching operation when the thread cassette 10 is attached to the cassette mount 5, a needle bar up-down moving mechanism 18 moving the needle bar 12 up and down, a needle bar rocking mechanism 19 rocking the needle bar 12, a needle thread take-up driving mechanism, etc.

The needle bar 12 is mounted on a needle bar holder 80 (see FIG. 15) for up-down movement. The needle bar holder 80 is further mounted on a sewing machine frame (not shown) of the sewing machine M so as to be rocked in the right-and-left direction. The sewing machine M is provided with a sewing machine motor 9 (see FIG. 17) which is driven to rotate a spindle (not shown) so that the needle bar up-down moving mechanism 18 is driven to move the needle bar 12 up and down. A manual pulley 33 is provided on a right end of the arm 3 (upper end of the pillar 2) for manually rotating the spindle.

The thread feeding mechanism 16A is provided for guiding the thread 11 drawn from the thread cassette 10 near a hole 12*b* (see FIG. 16) of the needle 12*a* mounted on the needle bar 12. The threading mechanism 16*b* asses the thread 11 guided by the thread feeding mechanism 16A through the needle hole 12*b*. The thread guiding mechanism 17 guides the thread 11 drawn from the thread cassette 10 so as to be caught by the needle bar thread guide 12*d* (see FIG. 1).

Figure 3:
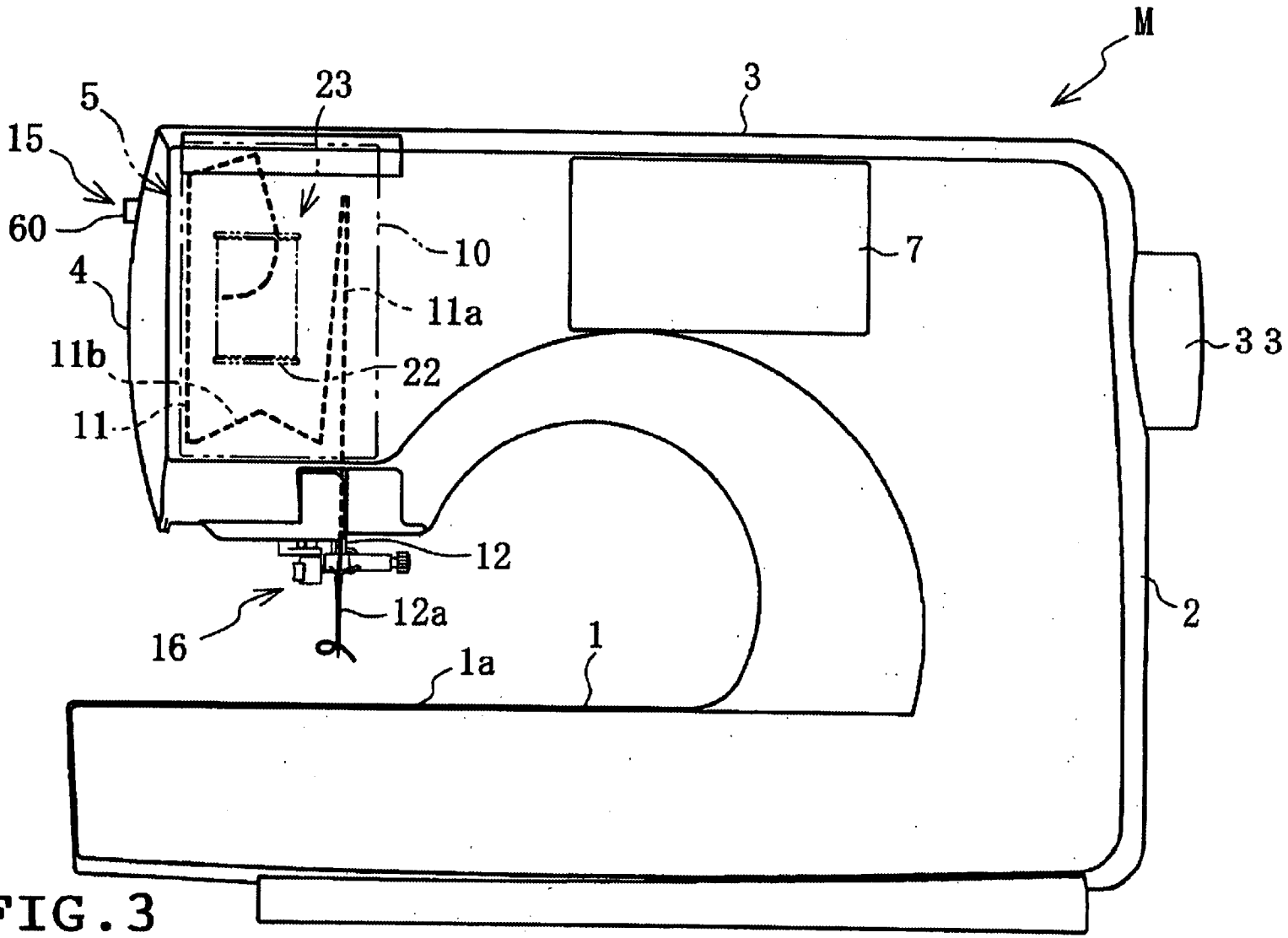
FIG. 3 is also a front view of the sewing machine to which the thread cassette has been attached.
Figure 4:
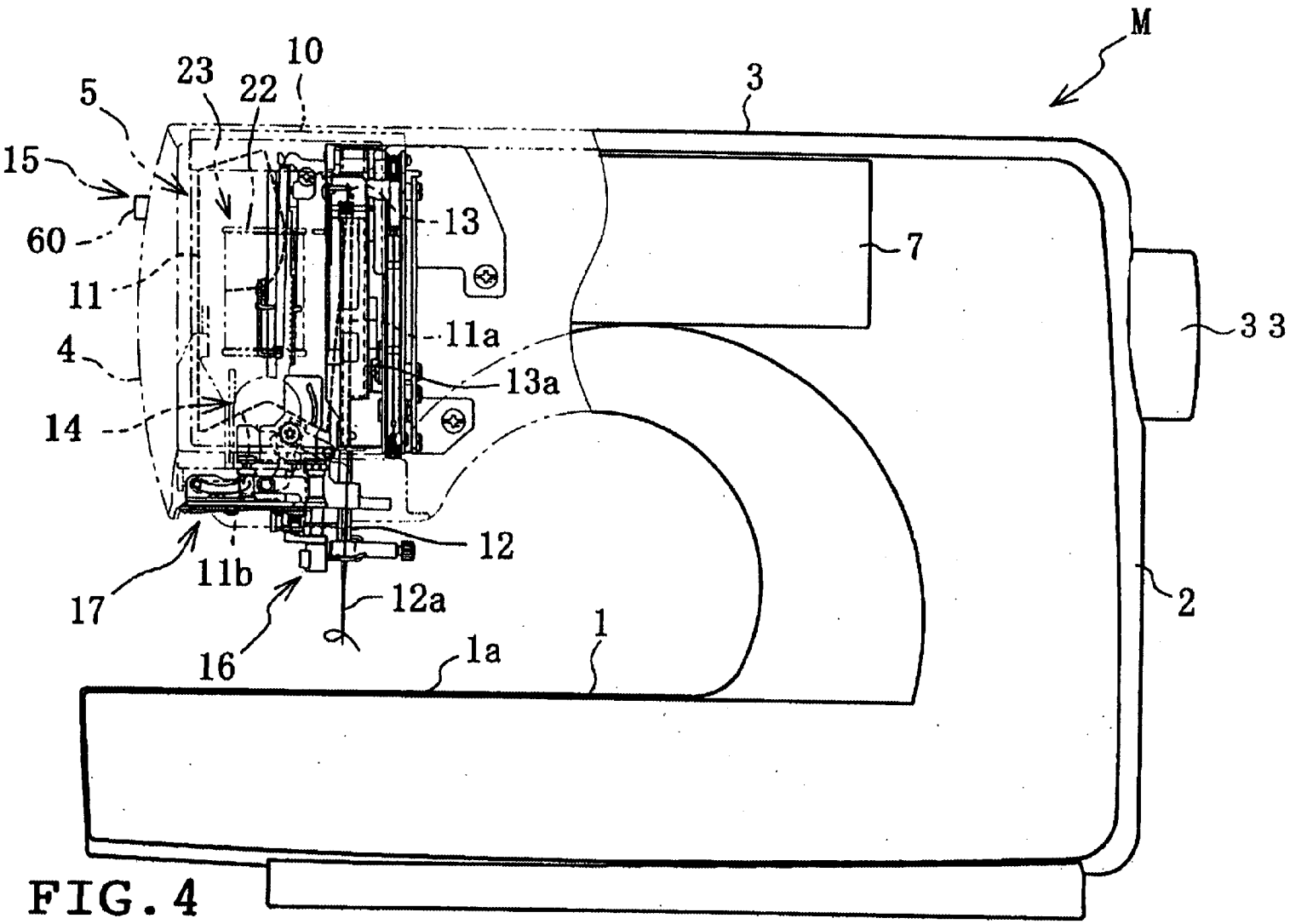
FIG. 4 is also a front view of the sewing machine in the same condition as in FIG. 3, showing the inner structure of the head.
Figure 5:
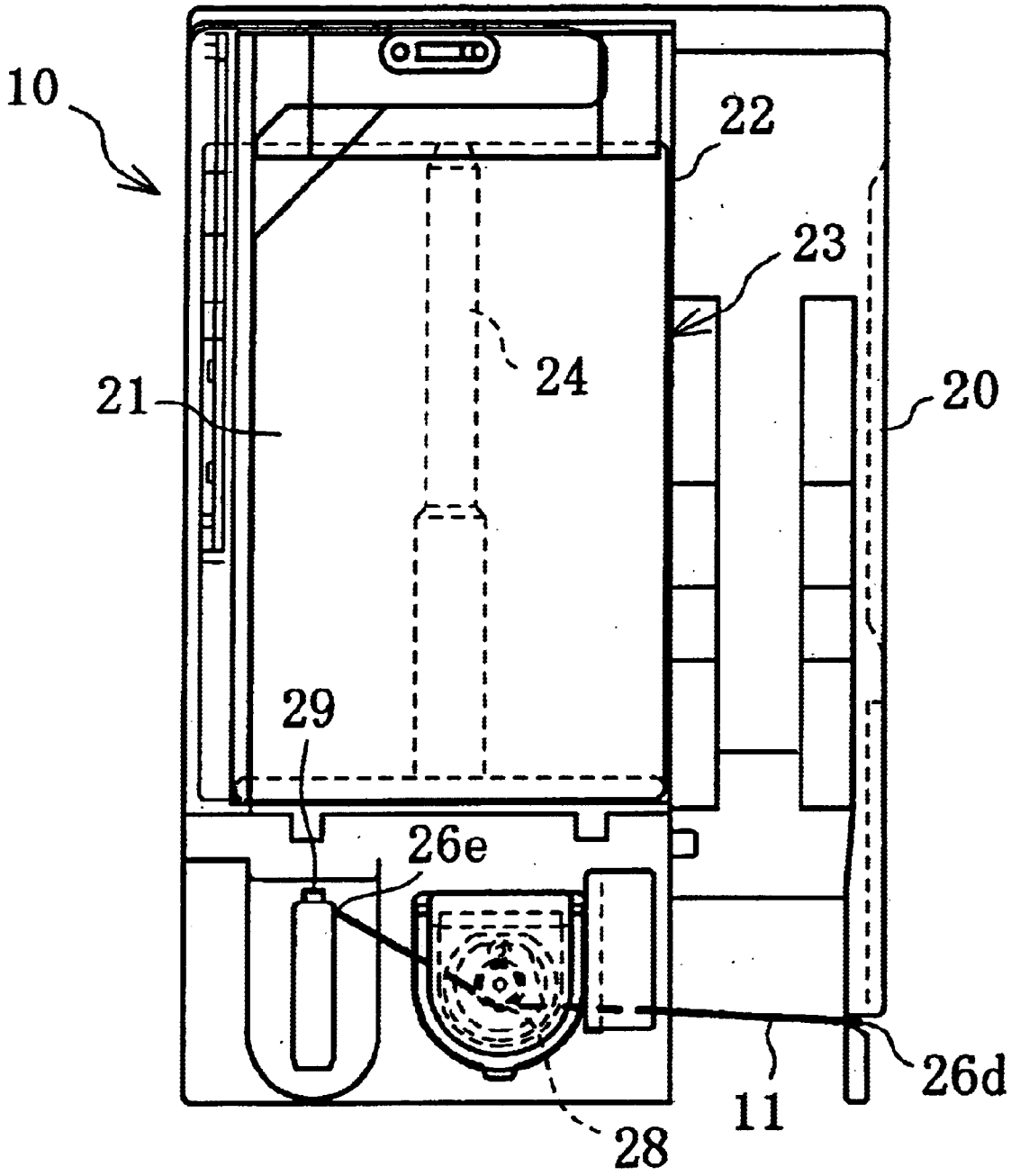
FIG. 5 is a front view of the thread cassette.
Figure 6:
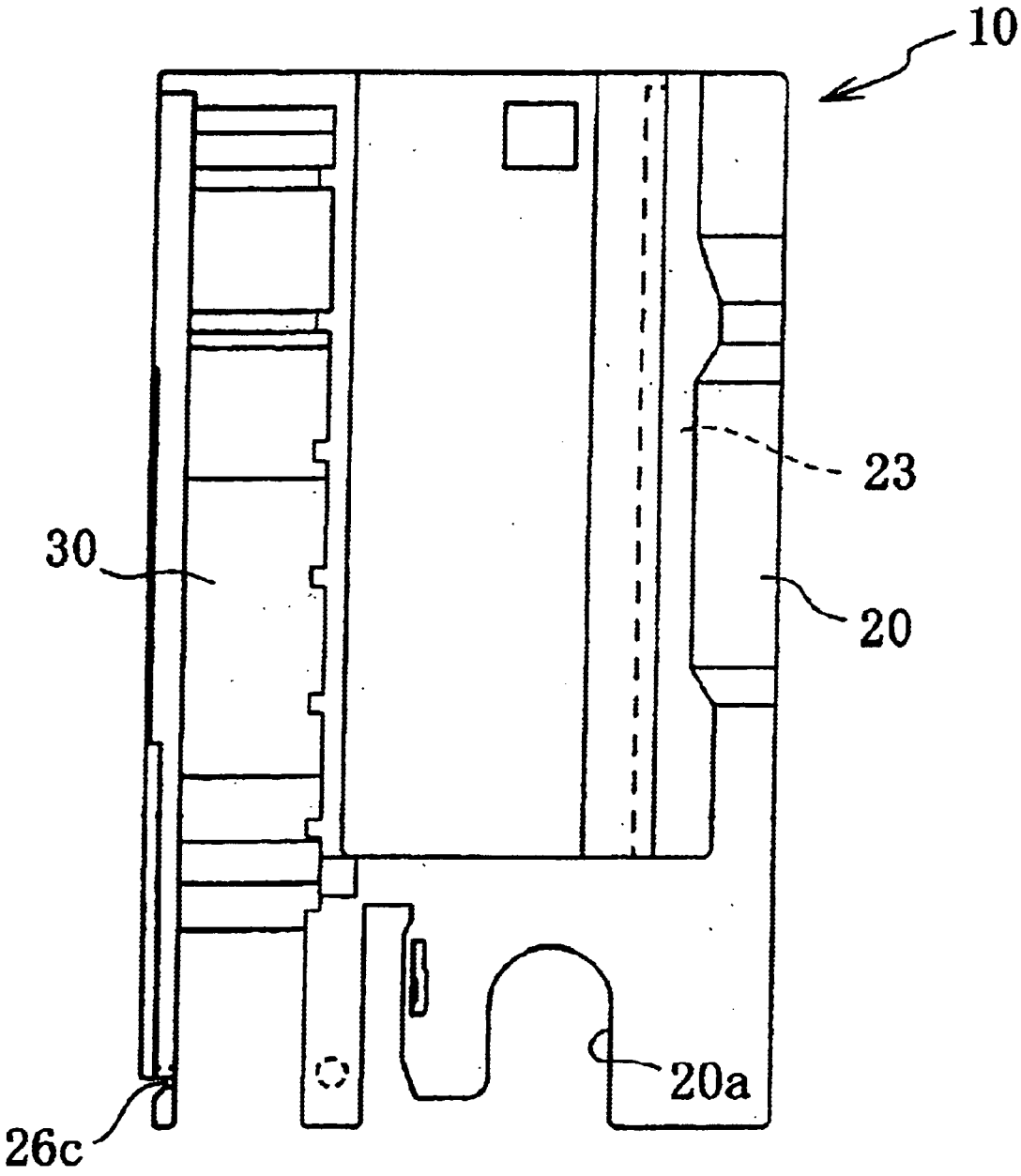
FIG. 6 is a rear view of the thread cassette.
Figure 7:
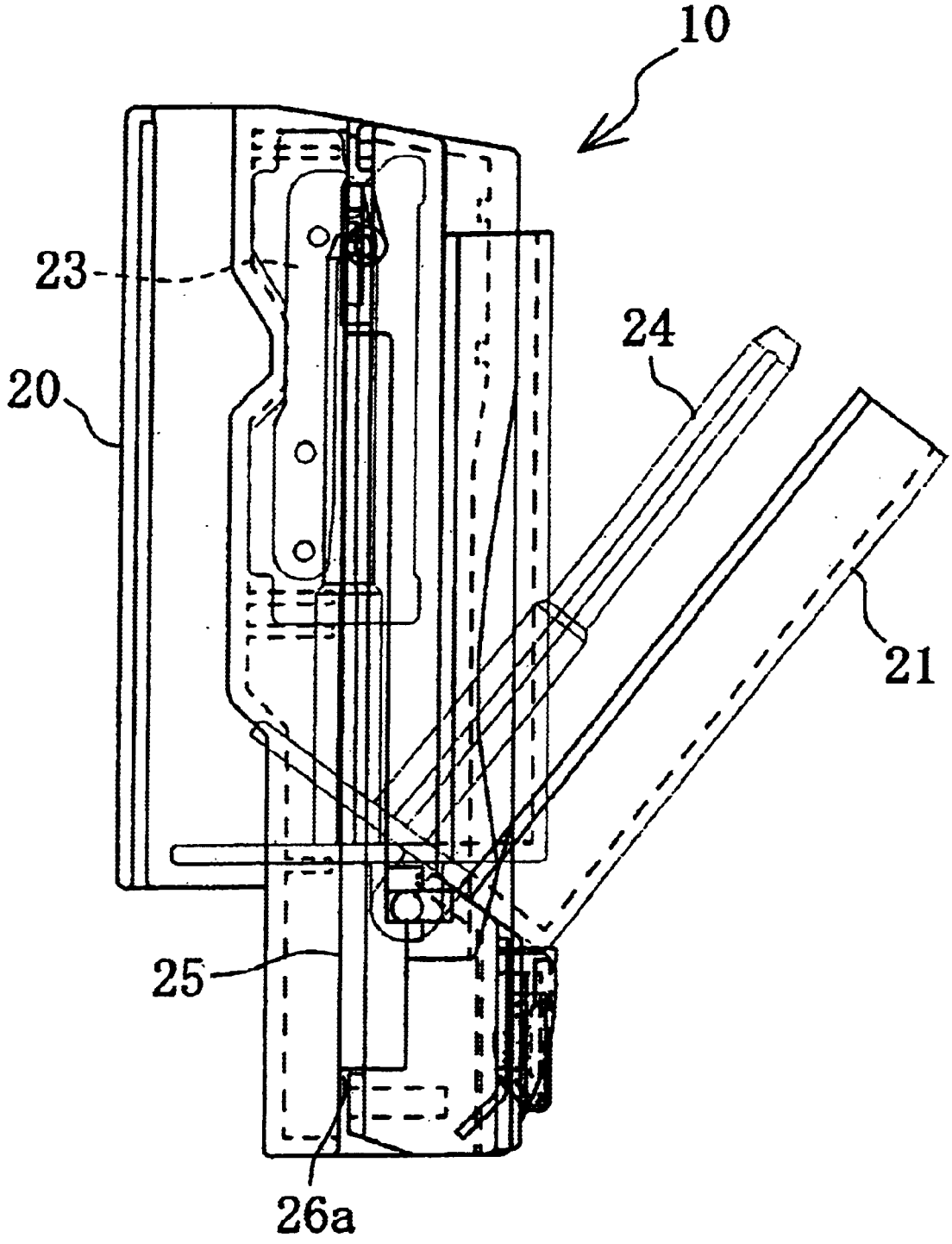
FIG. 7 is a left side view of the thread cassette with a closing member being open.
Figure 8:
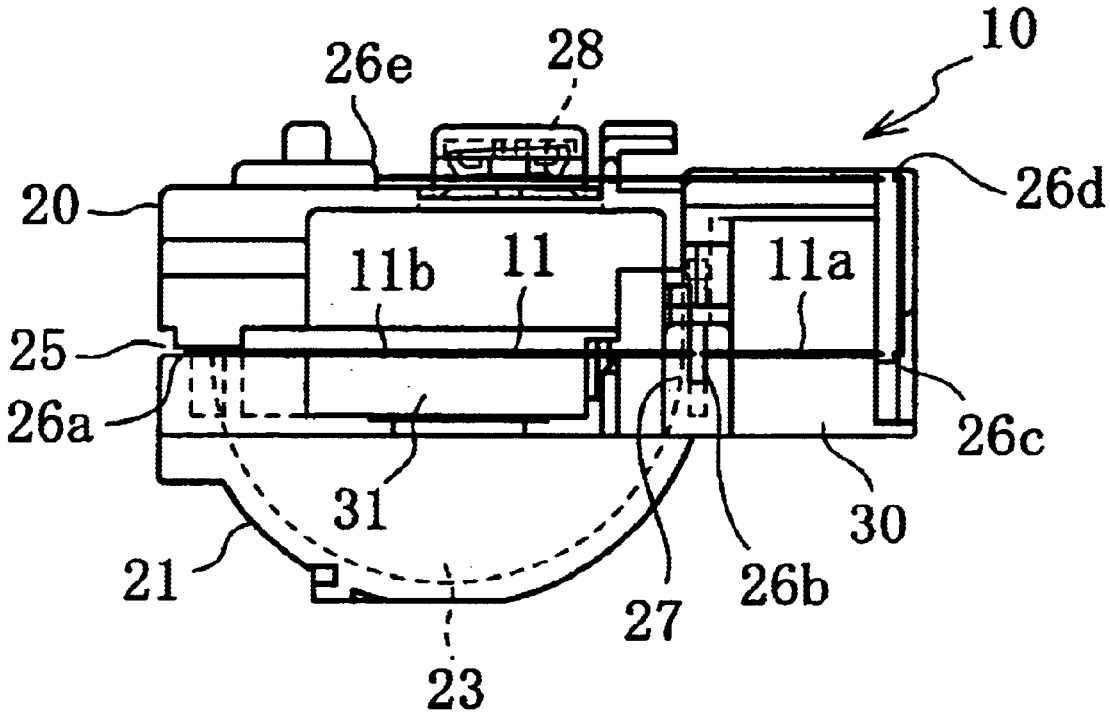
FIG. 8 is a bottom view of the thread cassette.
Figure 11:
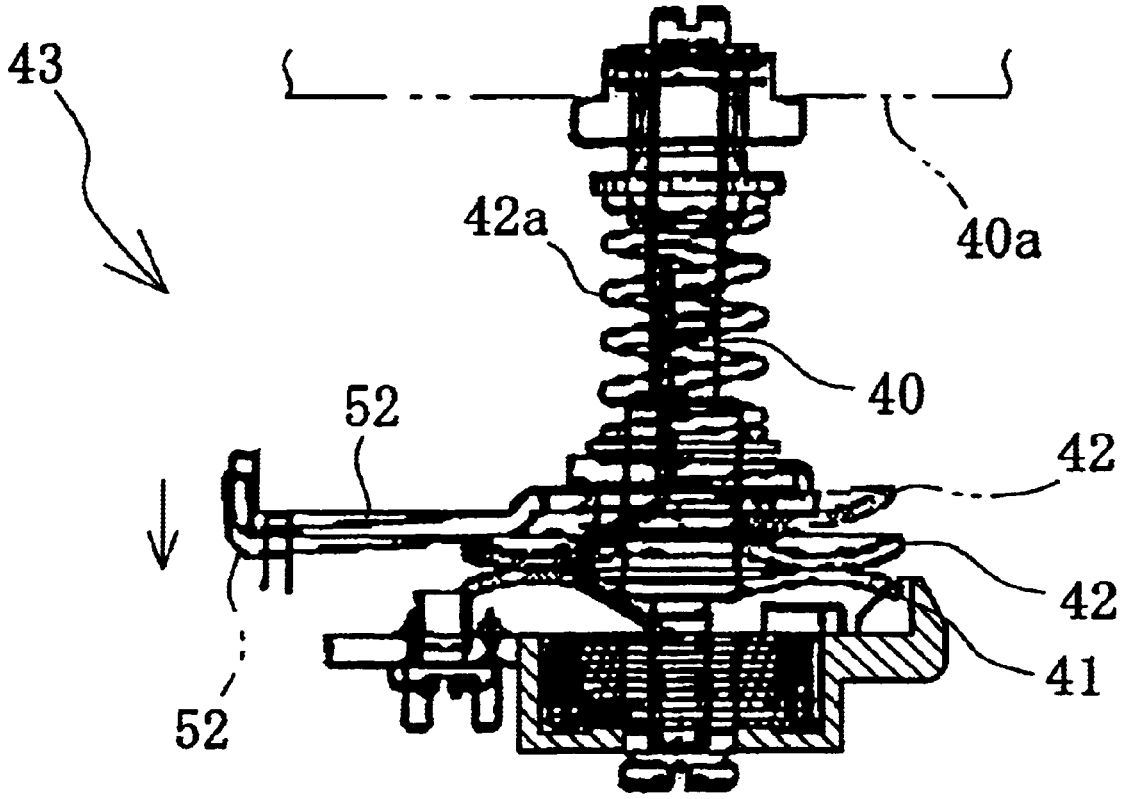
FIG. 11 is a plan view of the thread tensioning discs of the thread tensioning mechanism.

Referring to FIGS. 3 and 4, the thread 11 drawn from the thread cassette 10 attached to the cassette mount 5 is caught on a thread tensioning shaft 40 (see FIG. 11) between the paired thread tensioning discs 41 and 42 of the thread tensioning mechanism 14 from above. The thread 11 extending downstream is caught on the needle thread take-up 13. Furthermore, the thread 11 is caused to pass through the needle hole 12*b* of the needle 12*a*, whereby the sewing machine is set so as to perform the sewing.

On the other hand, a bobbin mount (not shown) is provided on the bed 1. A thread extending from a bobbin (not shown) serves as a bobbin thread. Furthermore, a shuttle mechanism (not shown) is provided in the bed 1. When the needle and bobbin threads are set and the motor 9 is driven, the shuttle mechanism is driven in synchronization with the up-down movement of the needle bar 12. The needle thread 11 is caught near the needle 12*a* moved downward lower than the needle plate 1*a* of the bed 1 by the shuttle mechanism, so that the needle and bobbin threads are entangled into stitches.

The thread cassette 10 will now be described. Referring to FIGS. 5 to 8, the thread cassette 10 includes a cassette body 20 and a closing member 21 pivotally mounted on the cassette body 20 so as to open and close a front opening of the body. A thread accommodating section 23 is defined in the cassette body 20 to accommodate a thread spool 22 serving as a thread supply. A spool pin 24 is mounted on the closing member 21. The spool pin 24 can be attached to and detached from the thread spool 22 when the closing member 21 is opened frontward. The thread spool 22 is accommodated in the accommodating section 23 when the closing member 21 is closed with the thread spool 22 being inserted onto the spool pin 24.

The thread 11 drawn from the thread spool 22 is guided upward outside the accommodating section 23. Passing along a thread passage 25 between the cassette body 20 and the left end of the closing member 21, the thread 11 is guided to a thread guide 26*a* of the left lower end of the thread cassette 10 to be caught on the thread guide. The thread 11 is further guided rightward to be caught on a thread guide 26*b* of the lower end of a partition wall 27 and a thread guide 26*c* of the right lower end of the thread cassette 10 in turn. The thread 11 is further guided forward to be caught on a thread guide 26*d* and then returned. The thread 11 is further guided leftward to be held by a thread holder 28. The thread 11 further extending leftward from the thread holder 28 is cut by a left-hand blade 29 of the thread holder and then caught on a thread guide 26*e*, thereby being set.

The thread cassette 10 from which the thread 11 is drawn to be set as described above is not attached to the cassette mount 5 but is ready for attachment. The thread cassette 10 has a needle thread take-up guide space 30 defined in a right end thereof The guide space 30 is open at the rear and lower portion of the thread cassette 10. The guide space 30 extends substantially over the entire vertical length. The thread cassette 10 has a thread tensioning space 31 formed in a central lower portion thereof. The thread tensioning space 31 is open downward. The spaces 30 and 31 are partitioned by a partition wall 27.

When attached to the cassette mount 5, the thread cassette 10 is inserted into the cassette mount 5 from above. In this case, the needle thread take-up 13 and a needle thread take-up guide 13*a* (see FIG. 2) guiding the take-up enter the guide space 30 from below, and the thread tensioning shaft 40 of the thread tensioning mechanism 14 and the thread tensioning discs 41 and 42 enter the thread tensioning space 31. The cassette body 20 has a notch 20*a* formed in a lower end of a rear wall thereof in order that an interference may be prevented between the thread tensioning shaft 40 and the thread cassette 10.

When the thread cassette 10 is inserted slightly into the cassette mount 5, a thread part 11*a* between the thread guides 26*b* and 26*c* is caught on the needle thread take-up 13 having entered the guide space 30. Thereafter, when the thread cassette 10 is further inserted into the cassette mount 5, the thread guides 26*a* and 26*b* are lowered relative to the needle thread take-up 13 on which the thread part 11*a* has been caught. However, since the thread 11 located downstream with respect to the thread part 11*a* is held by the thread holder 28, the thread 11 is drawn from the thread spool 22 in the thread accommodating section 23. For example, FIGS. 1 and 2 show a triangular thread part 11*a* when two thirds of the thread cassette 10 are inserted into the cassette mount 5.

When the thread cassette 10 has been attached to the cassette mount 5, a thread part 11*b* between the thread guides 26*a* and 26*b* is caught by the thread tensioning shaft 40 between the thread tensioning discs 41 and 42 having entered the thread tensioning space 31, as shown in FIGS. 3 and 4.

The thread tensioning mechanism 14 will now be described. Referring to FIGS. 9 to 13, the thread tensioning mechanism 14 includes the thread tensioning shaft 40 fixed to the frame 40*a* (see FIG. 12B) and extending rearward, the front thread tensioning disc 41 fixedly fitted with the thread tensioning shaft, the rear thread tensioning disc 42 fitted with the thread tensioning shaft so as to be brought into a face-to-face contact with the front thread tensioning disc, a thread tensioning spring 42*a* comprising a compression coil spring provided on the thread tensioning shaft 40 for urging the disc 42 against the forward disc 41, and a switching mechanism 43 including a pulse motor 44 opening and closing the discs 41 and 42.

Figure 2:
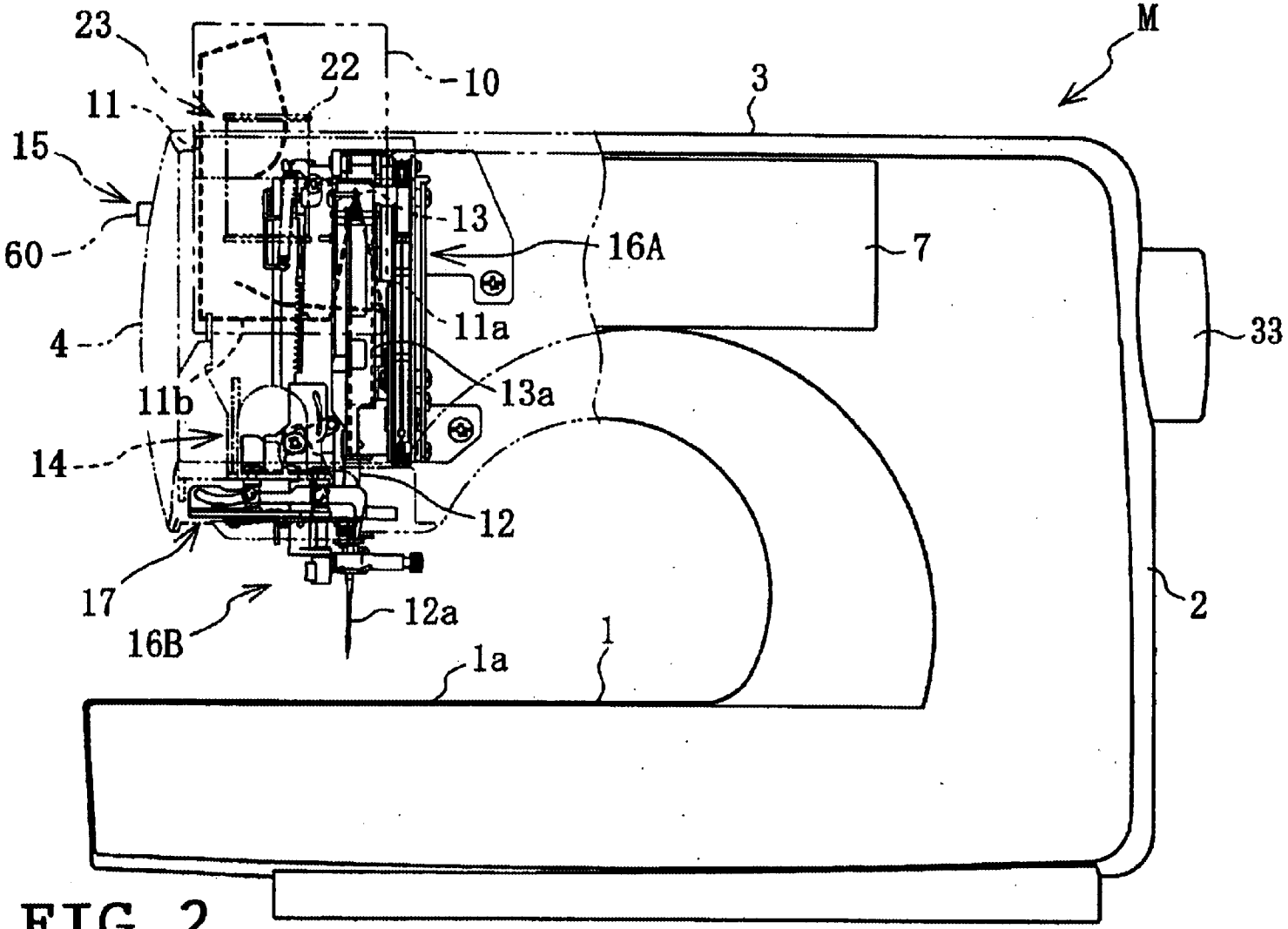
FIG. 2 is also a front view of the sewing machine in the same condition as in FIG. 1, showing the inner structure of the head.

Referring to FIGS. 2 and 13, the switching mechanism 43 includes a pulse motor 44, driving gear 45, cam member 46, link members 47 and 48, rotational link member 49 and extension coil spring 50, pushing link member 51 and opening lever member 52. The driving gear 45 secured to an output shaft of the pulse motor 44 is in mesh engagement with a gear 46*a* of the cam member 46. The link member 47 is pivotally mounted at its central portion on a support shaft 47*a* and an upper end at which a cam follow 47*b* engaging a cam groove 46*b* of the cam member 46. The link 48 is supported so as to be moved in the right-and-left direction.

The rotational link member 49 is pivotally mounted at its central portion on a support shaft 49. The rotational link member 49 is urged counterclockwise by the extension coil spring 50. The rotational link member 49 has a rear end formed with an engaging portion 49*b* which is in engagement with an elongated hole 48*b* formed in the left end of the link member 48. The rotational link member 49 has a right end formed with a pin 49*c* which is in engagement with a central elongated hole 51*b* of a pressing member 51. The pressing member 51 has a right end pivotally mounted on a support shaft 51*a*. An opening levee member 52 is fixed to the rear thread tensioning disc 42.

The paired thread tensioning discs 41 and 42 are closed when a cam follower 47*b* is in engagement with a cam groove 46*b*1 with the same diameter as the cam groove 46*b*. The cam groove 46*b*1 extends over about 80 degrees and can drive the pulse motor 44 in an angular range corresponding to the aforesaid angle of about 80 degrees while the cam follower 47*b* remains engaged with the cam groove 46*b*1. The reason for this is that the pulse motor 44 and driving gear 45 of the switching mechanism 43 also constitute a part of the needle bar rocking mechanism 19, whereupon the needle bar 12 can be rocked while the thread tensioning discs 41 and 42 are closed. The needle bar rocking mechanism 19 includes the Pulse motor 44, driving gear 45, a gear 19*a* brought into mesh engagement with the driving gear 45 and a cam 19*b* fixedly provided on the gear 19*a* and produces a rocking motion of the needle bar 12 by a rotating cam 19*b*.

Figures 13A, 13B:
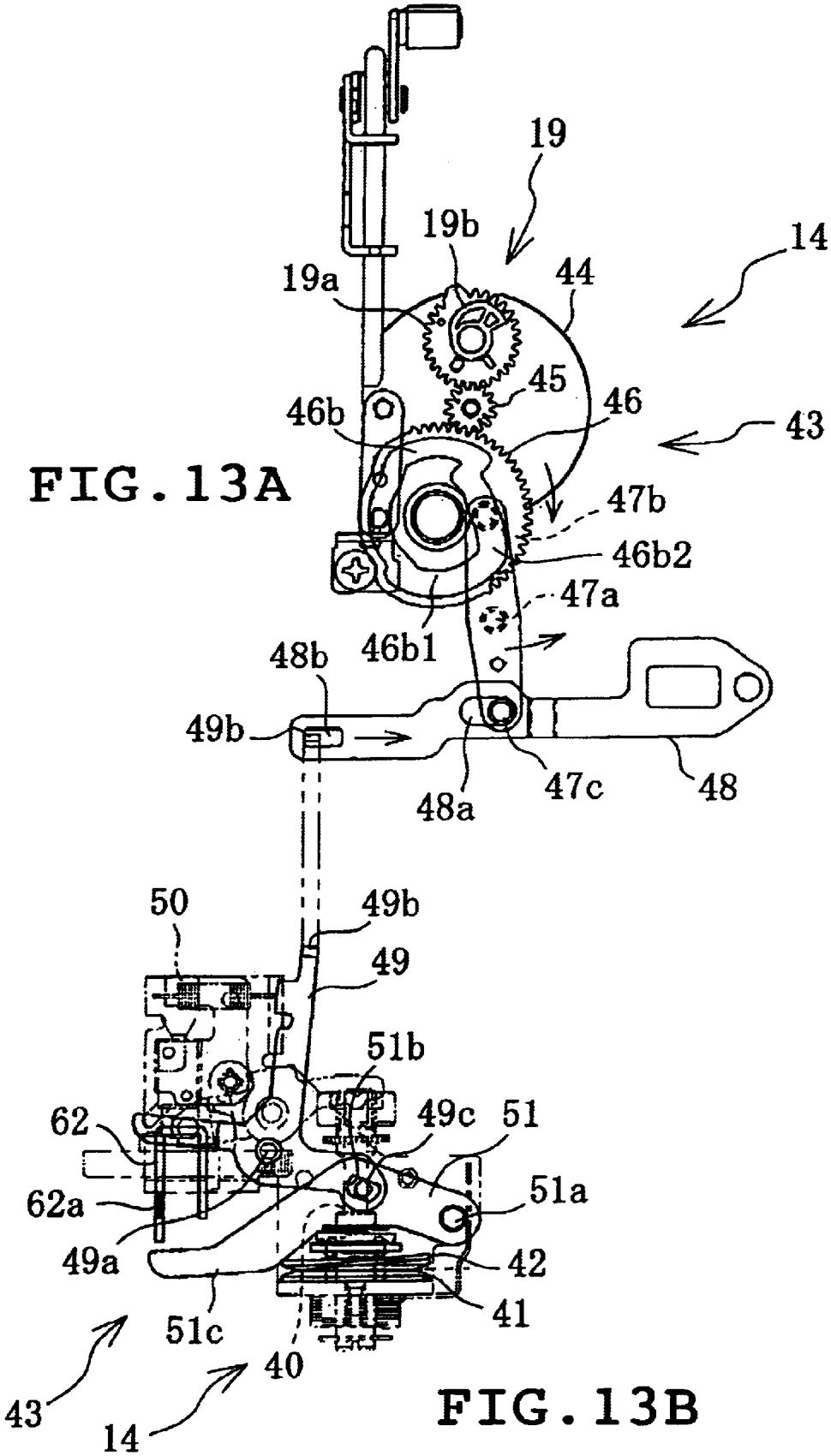
FIGS. 13A and 13B are front and plan views of the thread tensioning mechanism in the open state respectively.

On the other hand, upon drive of the pulse motor 44, the cam member 46 is rotated clockwise as shown by arrow in FIG. 13A so that the cam follower 47*b* engages the cam groove part 46b2 of the cam groove 46b, moving to the central side of the cam member 46. Then, the link members 47 and 48 and the rotational link member 49 are synchronously moved in the directions of arrows, so that the opening lever member 52 is pressed forward by the left lever 51c by the pressing member 51 moving forward. As a result, the rear disc 42 is moved so as to be inclined such that a space is defined between the discs, whereby the discs are opened.

When the thread cassette 10 is attached to the cassette mount 5 while the thread tensioning discs 41 and 42 are open, the thread part 11b of the thread 11 drawn from the thread cassette. 10 is caught on the thread tensioning shaft 40 between the discs 41 and 42. Successively, when the pulse motor 44 is driven so that the cam member 46 is rotated counterclockwise or in the direction opposite the arrow, the urging force of the extension coil spring 50 returns the rotational link member 49 to the former position, so that the discs 41 and 42 are closed by the thread tensioning spring 42a. The needle bar 12 is moved to the position as shown by the chain line in FIG. 9 while the paired thread tensioning discs 41 and 42 are open.

Figure 9:
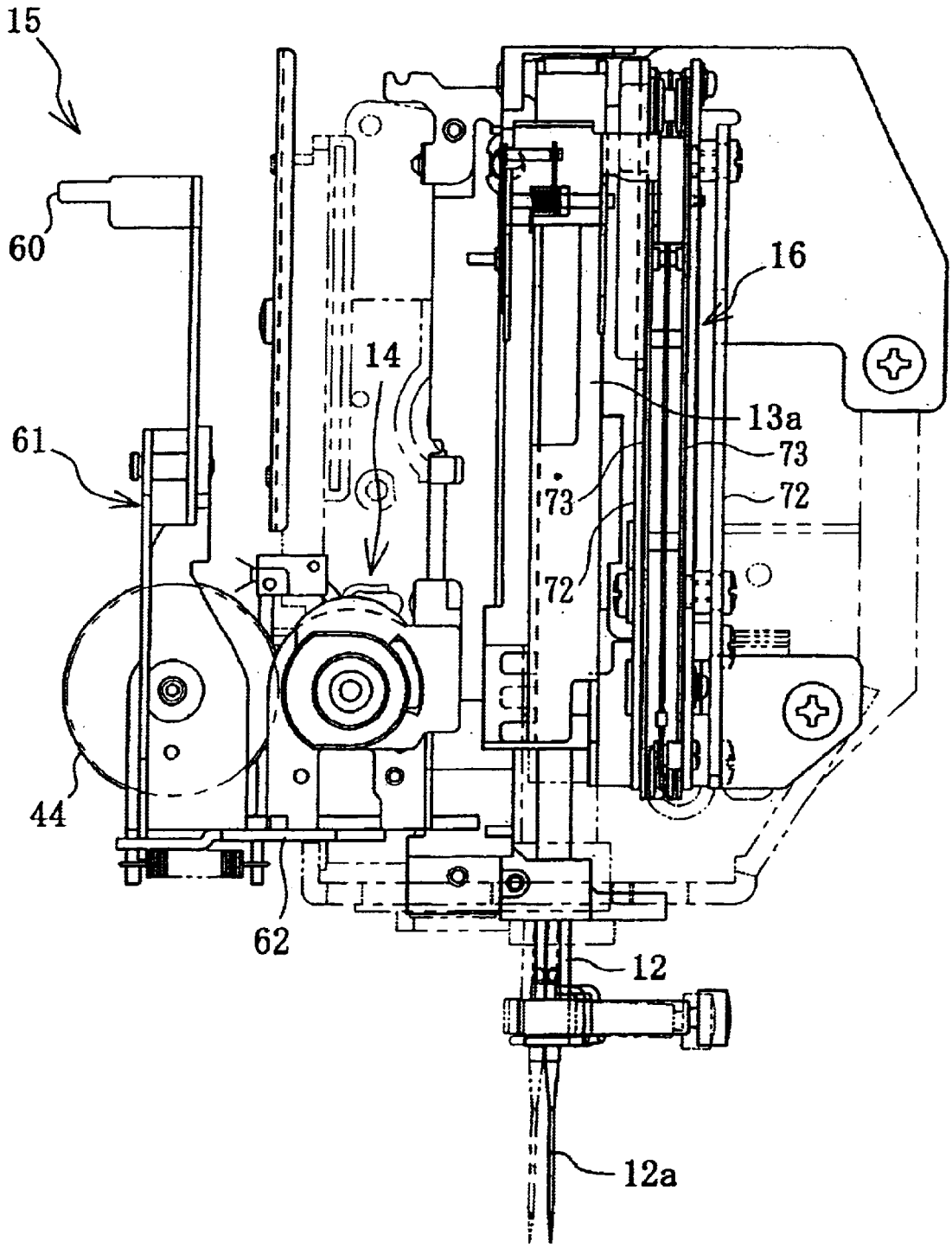
FIG. 9 is an enlarged front view of a needle bar up-down movement mechanism and needle bar rocking mechanism in the head of the sewing machine.
Figure 10:
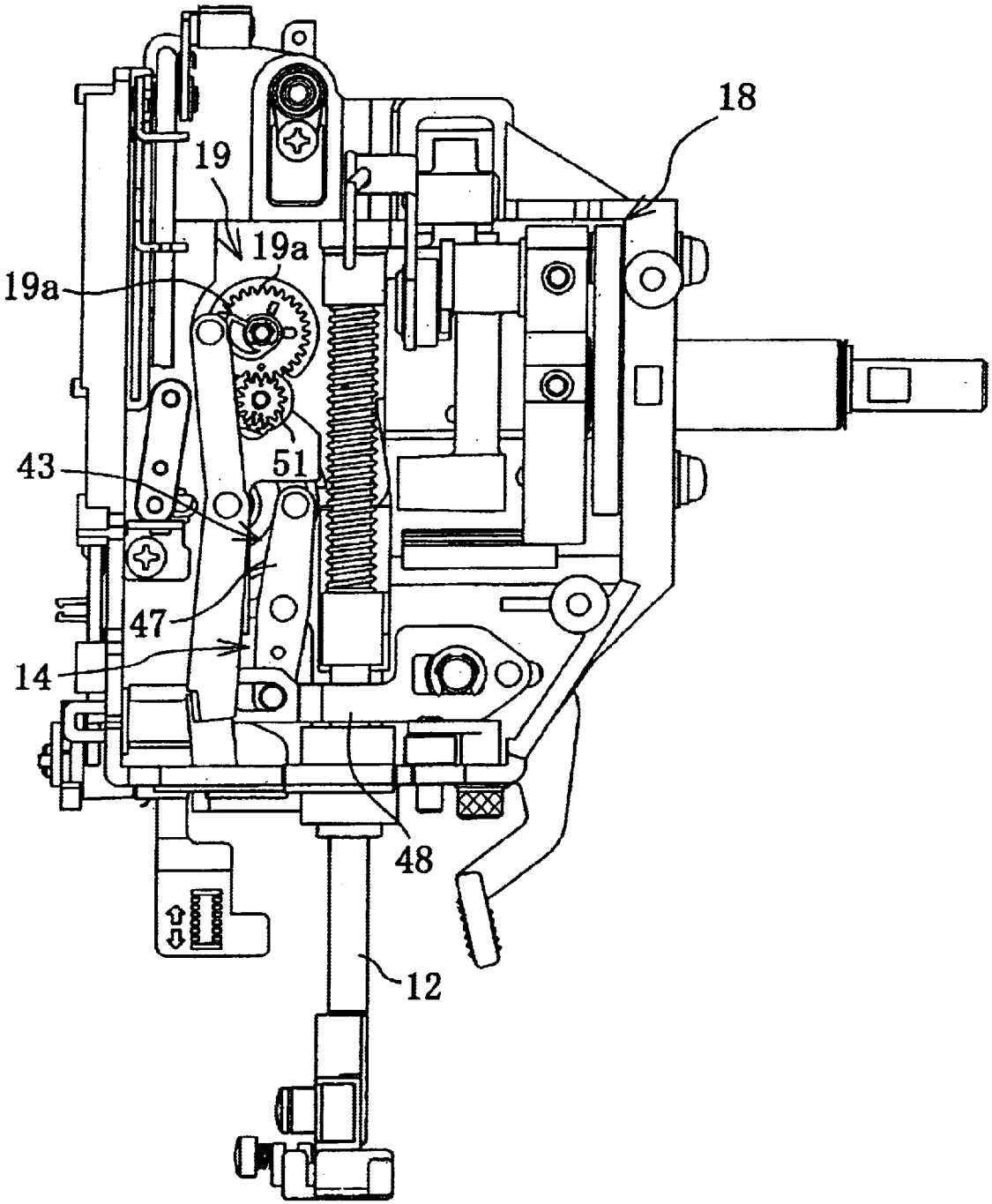
FIG. 10 is an enlarged front view of a thread feeding mechanism and thread tensioning mechanism in the head of the sewing machine.
Figures 12A, 12B:
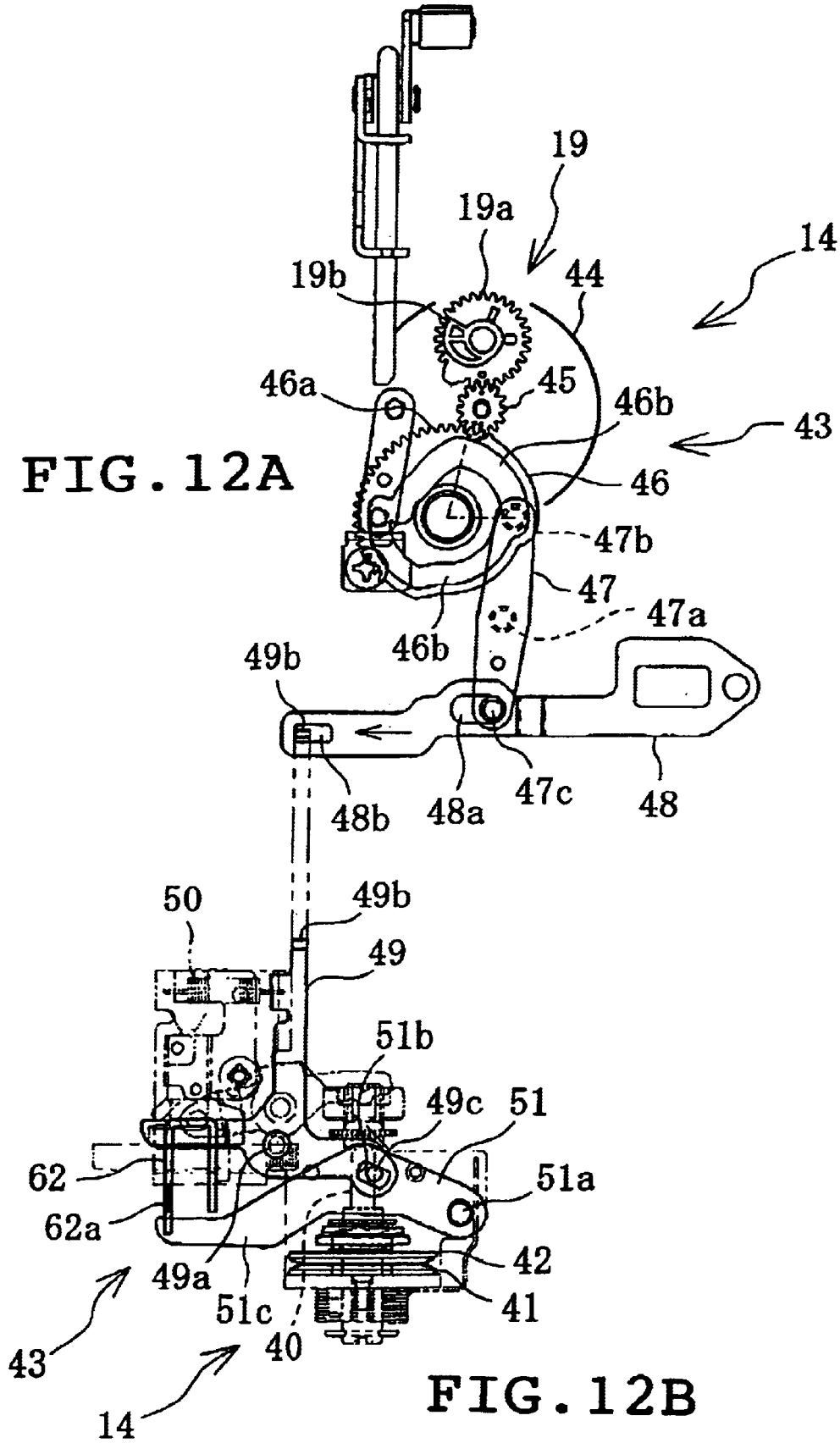
FIGS. 12A and 12B are front and plan views of the thread tensioning mechanism in the closed state respectively.

The thread tension releasing mechanism 15 will now be described. Referring to FIGS. 9, 12B and 13B, the thread tension releasing mechanism 15 includes a release operation member 60 operated to detach the thread cassette 10 from the cassette mount 5, an operating force transmitting mechanism 61 including a link mechanism transmitting an operating force of the release operation member 60, and a thread opening member 62 moved forward by the operating force transmitted via the operating force transmitting mechanism 61. In this construction, upon operation of the release operation member 60, the thread opening member 62 is moved forward so that the lever 51c of the pressing member 51 pushed forward by the pressing portion 62a of the thread opening member 62. As a result, the paired thread tensioning discs 41 and 42 are opened in the same manner as described above. In this case, the rotational link member 49 is rotated clockwise so that the engagement portion 49b is moved rightward. Since the engagement portion 49b is in engagement with the elongated hole 48b so as to be moved rightward, the link member 48 is not moved.

Figure 14:
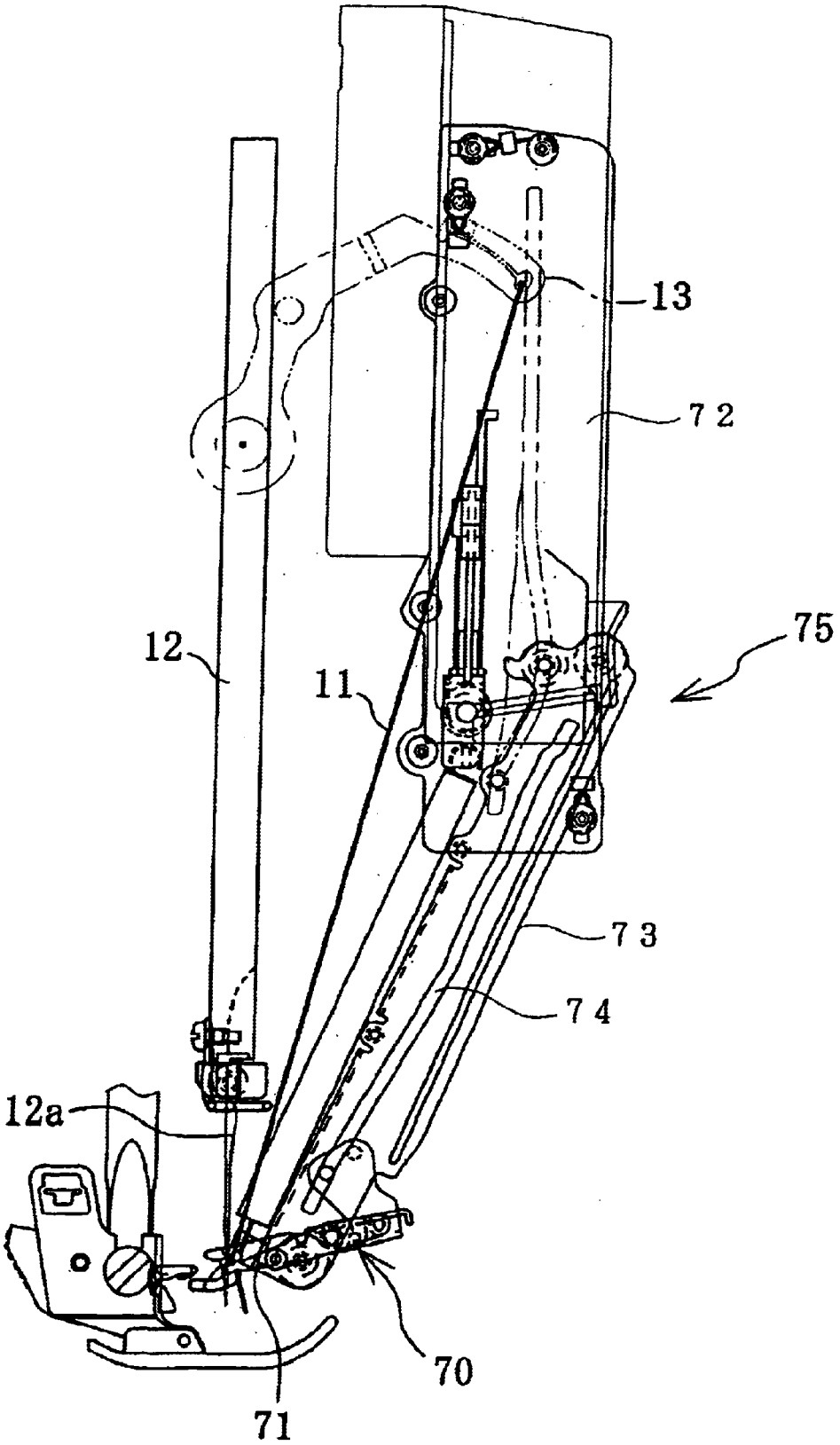
FIG. 14 is a left side view of the thread feeding mechanism.

The thread feeding mechanism 16A will be described. Referring to FIGS. 9 and 14, the thread feeding mechanism 16A includes a thread guide remember 70 catching the thread 11 drawn from the thread cassette 10 and a thread guide driving mechanism 75 lowering the guide member 70 from an upper stand-by position (see FIG. 9) via a catching position (not shown) to a thread feed position (see FIG. 14) while the attitude of the guide member is being changed.

The thread guide driving mechanism 75 includes a fixed support plate 72 mounted to the sewing machine frame, a moving support plate 73 moved up and down relative to the fixed support plate 72, and a running block mechanism operated in synchronization with insertion of the thread cassette 10 into the cassette mount 5. The moving support plate 73 has a side face formed with a guide groove 74 guiding the guide member 70 and extending substantially in the up-and-down direction. When the thread cassette 10 is attached to the cassette mount 5, the moving support plate 73 is lowered relative to the fixed support plate 72 and the guide member 70 is lowered relative to the moving support plate 73 thereby to be moved to the thread feed position.

The guide member 70 has a pair of thread guide plates 71, which catch a part of the thread 11 downstream relative to the needle thread take-up 13, at a guide position. The thread 11 is horizontally stretched while extending between the thread guide plates 71. When the guide member 70 is located at the thread feed position, the thread 11 extending between the thread guide plates 71 is located in front of the needle 12a near the needle hole 12b.

Figure 15A:
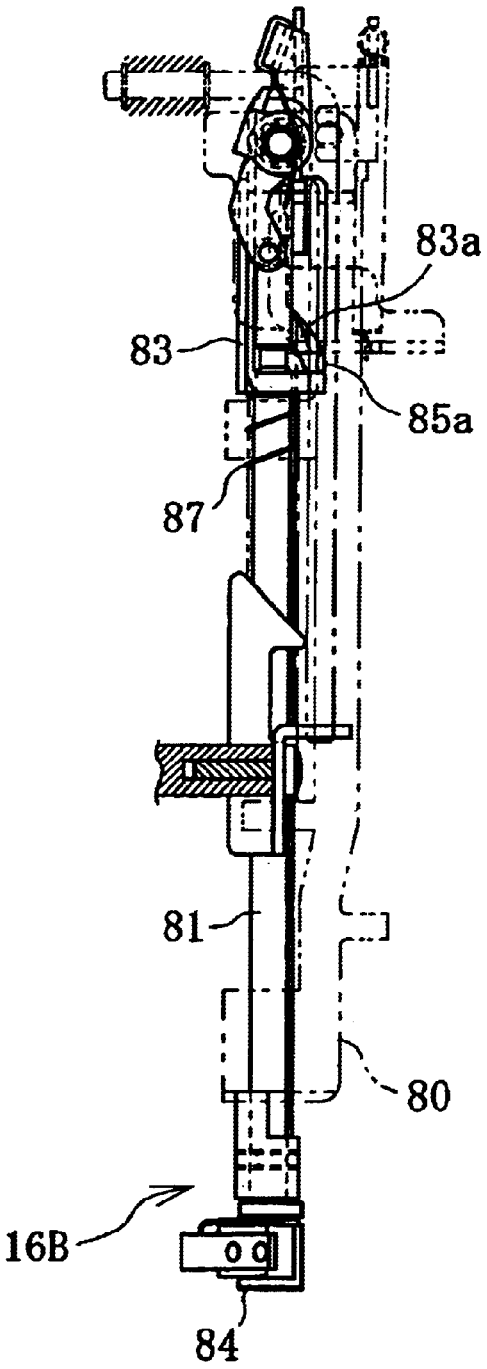
FIGS. 15A and 15B are left side and front views of the threading mechanism.
Figure 15B:
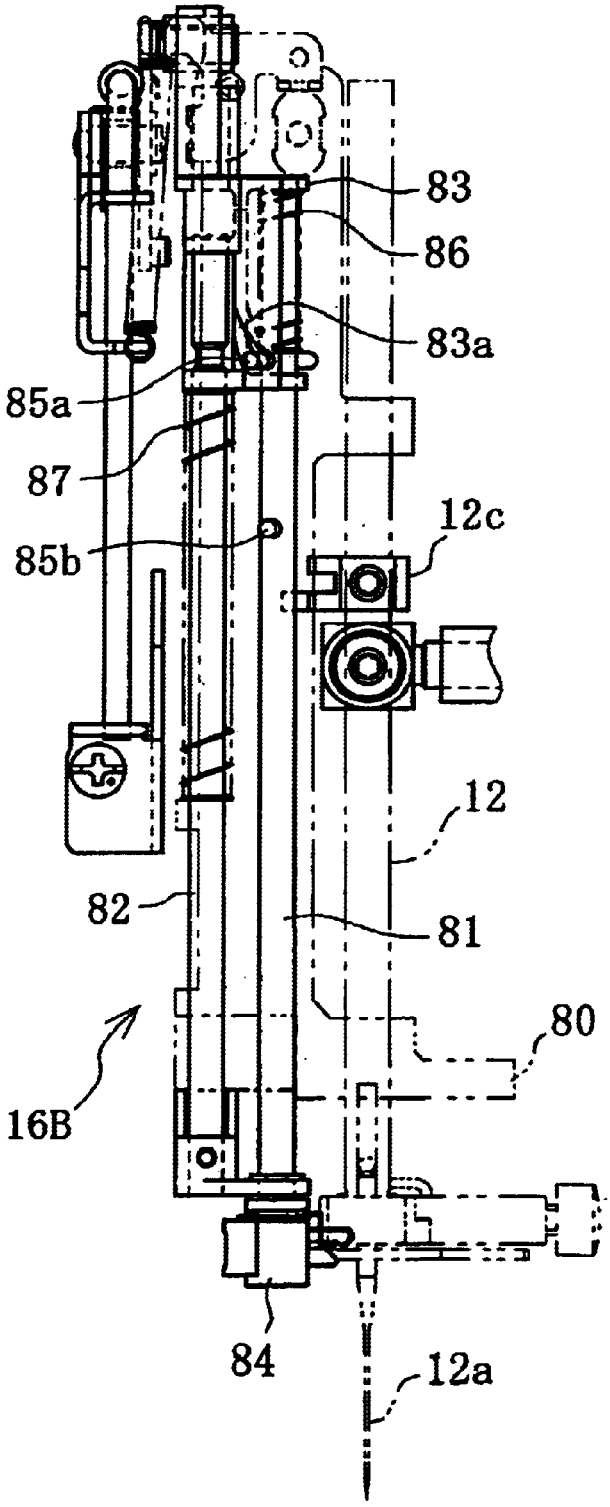

The threading mechanism 16B will be described. Referring to FIGS. 15 and 16, the threading mechanism 16B is provided on the needle bar frame 80 supporting the needle bar 12 and includes a threading shaft 81 and a slider guide shaft 82 both mounted on the needle bar frame 80 on the left of the needle bar 12 so as to be moved up and down, a threading slider 83 fitted with upper ends of the shafts 81 and 82 so as to be moved up and down, and a book mechanism section 84 mounted on the lower end of the threading shaft 81. The needle bar 12 and the threading mechanism 16B are moved integrally.

Two upper and lower pins 85a and 85b protrude from an upper portion of the threading shaft 81. The upper pin 85a is engaged with a spiral engagement groove 83a formed in the threading slider 83. The lower pin 85b is capable of engagement with an engagement member 12c secured to the needle bar 12 from above. A compression coil spring 86 is provided around the threading shaft 81 to urge the slider 83 upward relative to the threading shaft. The pin 85a is usually in engagement with the lower end of the engagement groove 83a. Furthermore, a compression coil spring 87 is provided around the slider guide shaft 82 to urge the slider 83 upward. The threading shaft 81 and the slider 83 are usually located at respective uppermost positions.

The hook mechanism section 84 includes a threading hook 88 capable of being passed through the needle hole 12b and having a thread catching portion 88a at its distal end, two guide members 89 located at both sides of the threading hook 88, and a wire 90 capable of engaging the thread catching portion 88a of the threading hook 88, The threading mechanism 16B is usually in the normal state as shown in FIG. 15 when the thread cassette 10 is not attached to the cassette mount 5 and the thread cassette 10 is attached to the cassette mount 5. On the other hand, when the thread cassette 10 is inserted into the cassette mount 5, the threading slider 83 is lowered. The threading shaft 81 is also lowered together with the threading slider 83 at an initial stage. When the pin 85b of the threading shaft 81 engages the engagement member 12c of the needle bar 12 from above, the lower movement of the threading shaft 81 is prohibited, whereupon the threading shaft is stopped. As a result, the threading shaft 81 is positioned relative to the needle bar 12 with respect to its up-and-down position.

Figure 16A:
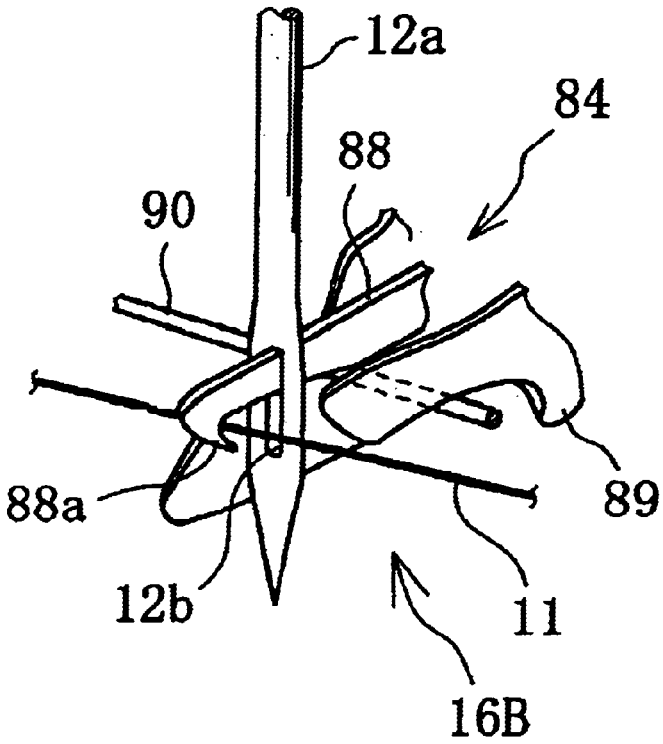
FIGS. 16A and 16B are enlarged perspective views of the threading mechanism when a threading hook of the threading mechanism has passed through the needle hole and when the threading hook has been returned through the needle hole such that the thread has been passed through the needle hole.
Figure 16B:
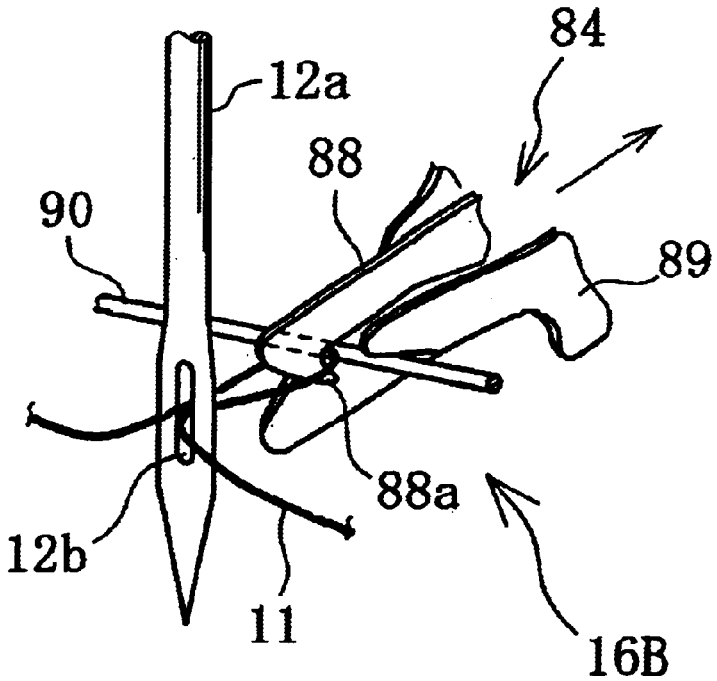

Thereafter, when the threading slider 83 is further lowered relative to the threading slider 81, the pin 85a moves upward along the spiral engagement groove 83a of the threading slider 83 while engaging the groove, whereupon the threading shaft 81 is rotated. The hook mechanism 84 is located near the needle 12a and moreover, the thread 11 drawn from the thread cassette 10 is also carried near the needle 12a to be held in front of the needle in the stretched state, More specifically, upon rotation of the threading shaft 81, the hook 88 of the hook mechanism section 84 is passed through the needle bole 12b as shown in FIG. 16A and the thread 11 is caught on the distal end thread catching portion 88a as shown in FIG. 16B. Successively, the threading shaft 81 is rotated in the opposite direction so that the threading hook 88 is returned through the needle hole 12b, whereby the thread 11 extends through the needle hole. The thread 11 is also caught on the needle bar guide 12d by the thread guiding mechanism 17. Upon completion of the threading operation, the threading mechanism 16B is returned to the normal state as shown in FIG. 15 by a spring force or the like. Furthermore, the guide member 70 of the thread feeding mechanism 16A is returned to the stand-by position.

The needle bar 12 and the threading mechanism 16B are rocked integrally relative to the sewing machine frame, whereas the thread feeding mechanism 16A is fixedly provided relative to the sewing machine frame. This changes the relation between the position of the needle hole 12*b* and the position of the thread 11 having been carried by the thread feeding mechanism 16A depending upon a zigzag position of the needle bar 12. Accordingly, there is a possibility that the threading hook 88 cannot catch the thread 11 fed by the thread feeding mechanism 16A. Furthermore, regarding the vertical position of the needle bar 12, too, if the level of the needle hole 12*b* does not have a proper positional relation with the position of the thread 1 having been carried by the thread feeding mechanism 16A, there is a possibility that the threading operation cannot be carried out by the threading mechanism 16B.

In the sewing machine M, the needle bar 12 is located at a predetermined position near a needle top position and at a predetermined zigzag position as shown by chain line in FIG. 9. In this state, when the thread feeding mechanism 16A and threading mechanism 16B are operated, he sewing machine is set so that the thread 11 can reliably be passed through the needle hole 12*b*. More specifically, the left needle position as shown in FIG. 9 is set relative to the position of the thread feeding mechanism 16A. Furthermore, the predetermined position near the needle top position is previously set in a range from 20 to 50 degrees as a tbreadable rotational angle range of the spindle.

A cassette detecting switch 102 (see FIG. 17) is provided near the lower end of cassette mount 5 for detecting ejection of the thread cassette 10 from the cassette mount 5. The cassette detecting switch 102 comprises a limit switch, for example. The switch 102 is turned on when the thread cassette 10 has been attached to the cassette mount 5. The switch 102 is turned off when the thread cassette 10 has been ejected from the cassette mount 5. Accordingly, attachment of the thread cassette 10 to the cassette mount 5 can be detected by the cassette detecting switch 102.

A spindle rotation angle detecting sensor 101 (see FIG. 17) is provided on the spindle for detecting a rotation angle of the spindle. The spindle rotation angle detecting sensor 101 comprises an encoder, for example, and detects a rotation angle of the spindle. In this case, a rotation angle corresponding to the uppermost position of the needle bar 12 (needle 12*a*) is set at 0 degrees (360 degrees).

Figure 17:
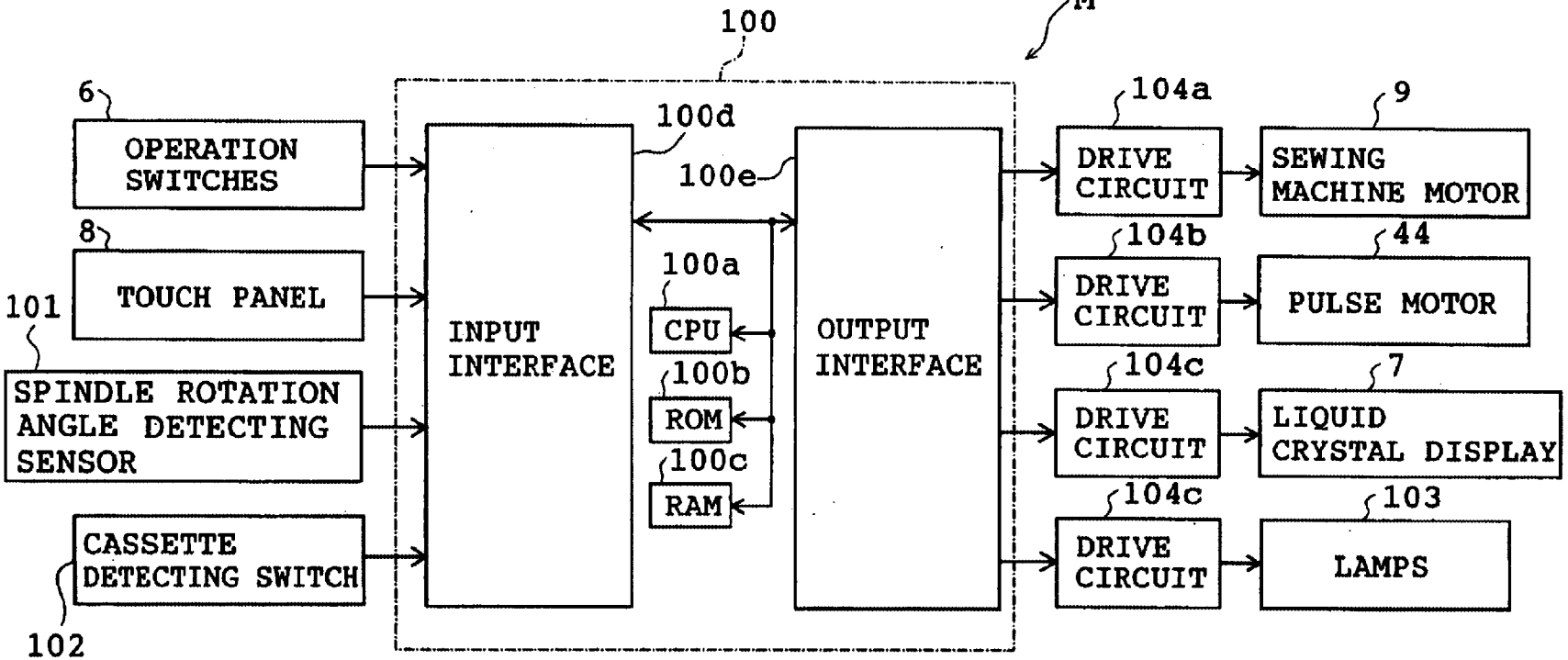
FIG. 17 is a block diagram showing the arrangement of the control system of the sewing machine.
Figure 18:
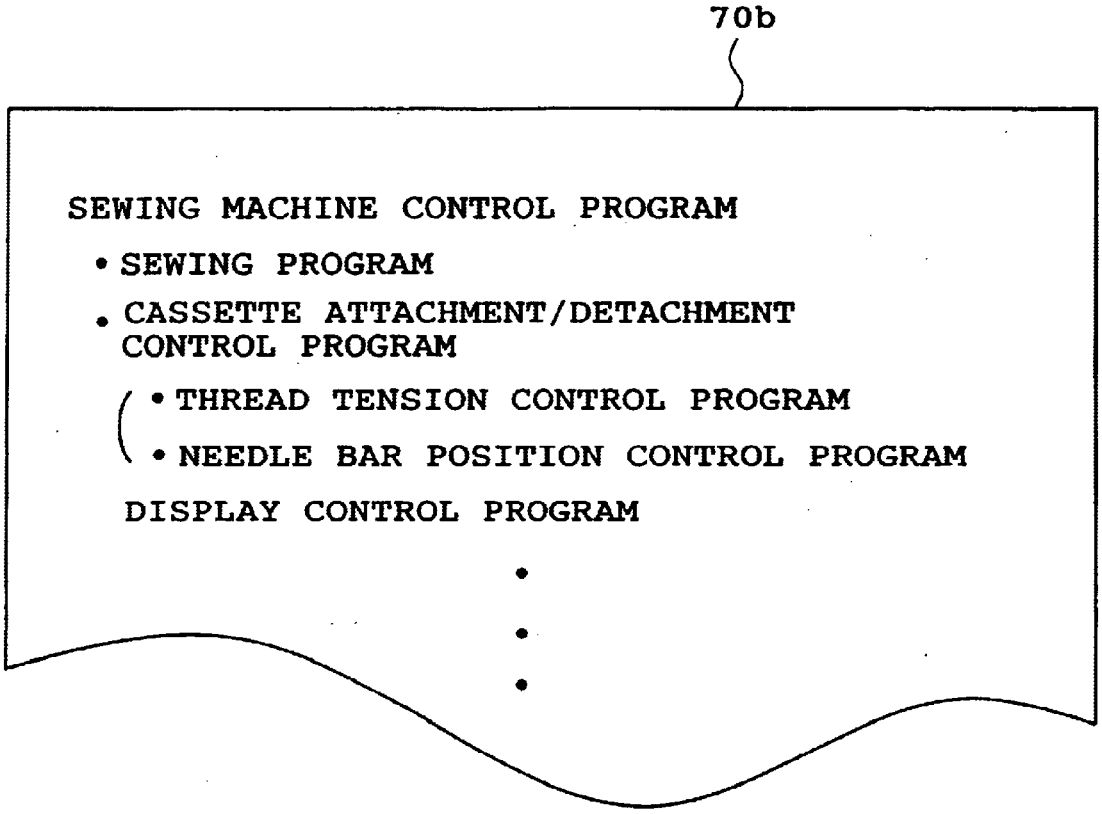
FIG. 18 shows a program stored in ROM of the control device.

The control system of the sewing machine M will now be described. Referring to FIG. 17, a control device 100 of the sewing machine M comprises a microcomputer including CPU 100*a*, ROM 100*b*, RAM 100*c* an input interface 100*d* and an output interface 100*e*. To the input interface 100*d* are electrically connected operation switches 6, a touch panel 8, a spindle rotation angle detecting sensor 101 and a cassette detecting switch 102. To the output interface 100*e* are electrically connected drive circuits 104*a* to 104*d* for driving the sewing machine motor 9, pulse motor 44, liquid crystal display 7 and lamps 103 respectively. ROM 100*b* stores a control program for the sewing machine M as shown in FIG. 18. The control program includes a sewing control program for executing a normal sewing operation, a cassette attachment/detachment control program including a thread tension control program for attaching and detaching the thread cassette 10 to and from the cassette mount 5 and a needle bar position control program, a display control program for displaying various pieces of information on the liquid crystal display 7, and the like.

Upon execution of the control program, the control device 100 controls the needle bar rocking mechanism 10 (the pulse motor 44) so that the needle bar 12 is rocked to a predetermined zigzag position or left needle position where the needle can be threaded by the thread feeding mechanism 16A and the threading mechanism 16B, when detachment of the thread cassette 10 from the cassette mount 5 has been detected by the cassette detecting switch 102, as will be described in detail later. With this, the control device 100 controls the thread tensioning mechanism 14 (the pulse motor 44) so that the thread tension discs 41 and 42 are opened, when detachment of the thread cassette 10 from the cassette mount 5 has been detected by the cassette detecting switch 102.

The control device 100 further stops the needle bar up-down moving mechanism 18 (the sewing machine motor 9) when detachment of the thread cassette 10 from the cassette mount 5 has been detected by the cassette detecting switch 102 while the spindle is being driven to operate the mechanism 18. In this case, the control device 100 stops the needle bar 12 at a position where threading can be performed and which is near the needle top, based on the results of detection by the spindle rotation angle detecting sensor 101, More specifically, the needle bar 12 is stopped at a position corresponding to any rotation angle of the spindle ranging from 20 to 50 degrees, for example, 45 degrees. Thus, the control device 100 serves as needle bar position control unit, needle bar up-down movement stopping unit, and thread tension control unit.

Figure 19:
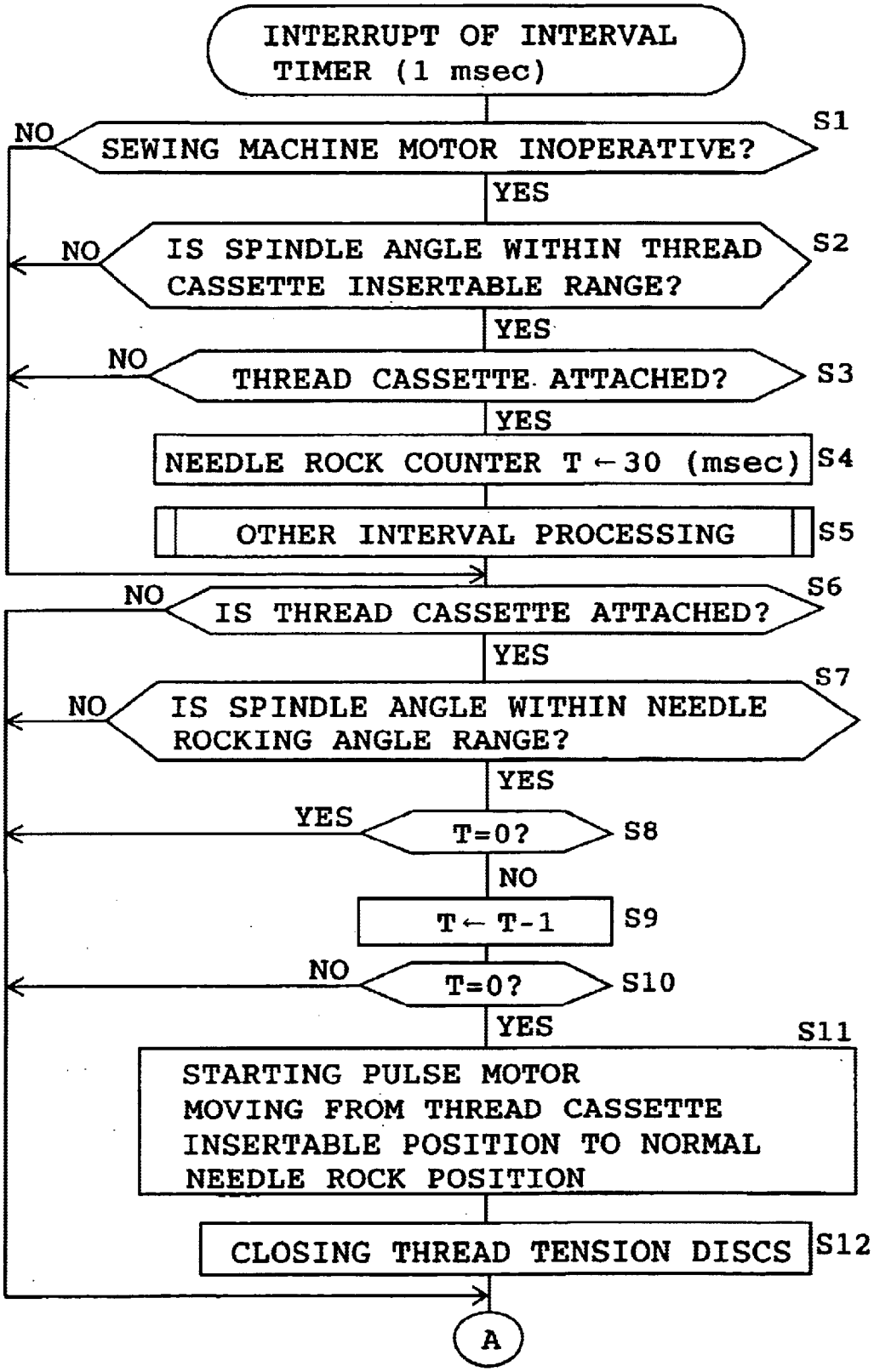
FIG. 19 is the first half of the flowchart showing the procedure of processing for attachment and detachment of the thread cassette carried out by the control device.

When attachment of the thread cassette 10 to the cassette mount 5 has been detected by the cassette detecting switch 102, the control device 100 controls the needle bar rocking mechanism 10 (the pulse motor 44) so that the needle bar 12 is rocked to a sewing start position (a neutral Position where the needle 12*a* is directed directly below, after a predetermined period of time, for example, 30 msec, The control executed by the control device 100 and including the cassette attachment/detachment will be described with reference to FIGS. 19 and 20. As shown in FIG. 19, the control starts with an interrupt at intervals of 1 msec. and the control device 100 advances to step S2 when the sewing machine motor 9 is turned off (step S1). When the spindle angle is within a thread cassette insertable angular range (YES at step S2), the control device 100 advances to step S3. When determining that the thread cassette 10 has been attached to the cassette mount 5 with turn-on of the cassette detecting switch 102 (YES at step S3), the control device 100 advances to step S4 to set the zigzag counter T at 30 (msec), then advancing to step S5. The control device 100 advances directly to step S5 when determination is made in the negative at each of steps S1 to S3. In the other interval processing at step S5, the control device 100 executes scan of pattern keys and the like, read of speed volume and read of speed of the sewing machine motor 9.

The rotation angle of the spindle is obtained by operation on the basis of information supplied by the spindle rotation angle sensor 101 comprising an encoder. In this case, a rotation angle of the spindle in the case where the needle bar 12 is at the needle top which is an upper limit position is set at 0 degrees (360 degrees). The thread cassette insertable angle ranges from 280 to 75 degrees, for example.

When the thread cassette 10 is attached to the cassette mount 5 and accordingly, the cassette detecting switch 102 is in the ON-state after the other interval processing at step S5 (YES at step S6), the control device 100 advances to step S7. The control device 100 advances to step S8 when the spindle angle is within a zigzag angle range (YES at step S7). The zigzag angle range may be basically an angular range in which the needle 12*a* is located above the needle plate la and is previously ranged from 280 to 75 degrees.

When the count of the zigzag counter T is 0 (NO at step S8), the control device 100 advances to step S9 to decrement the counter T to (T−1), further advancing to step S10. When the counter of the zigzag counter T is 0 (YES at step S10), the control device 100 advances to step S11. The control device 100 advances to step S13 when determination is made in the negative at each of steps S6 to S8 and S10.

When determination is made in the affirmative at step S10, the pulse motor 44 is driven so that the cam member 13 is rotated to the position as shown in FIG. 13A at step S11, whereupon the needle bar 12 is moved from the thread cassette insertable position corresponding to the left needle position and a position where the needle 12 can desirably be threaded by the threading mechanism 16B to a normal zigzag position or a neutral position where the needle bar is vertical. With this, the paired thread tension discs 41 and 42 are closed at step S12, and the control device 100 then advances to step S14.

Figure 20:
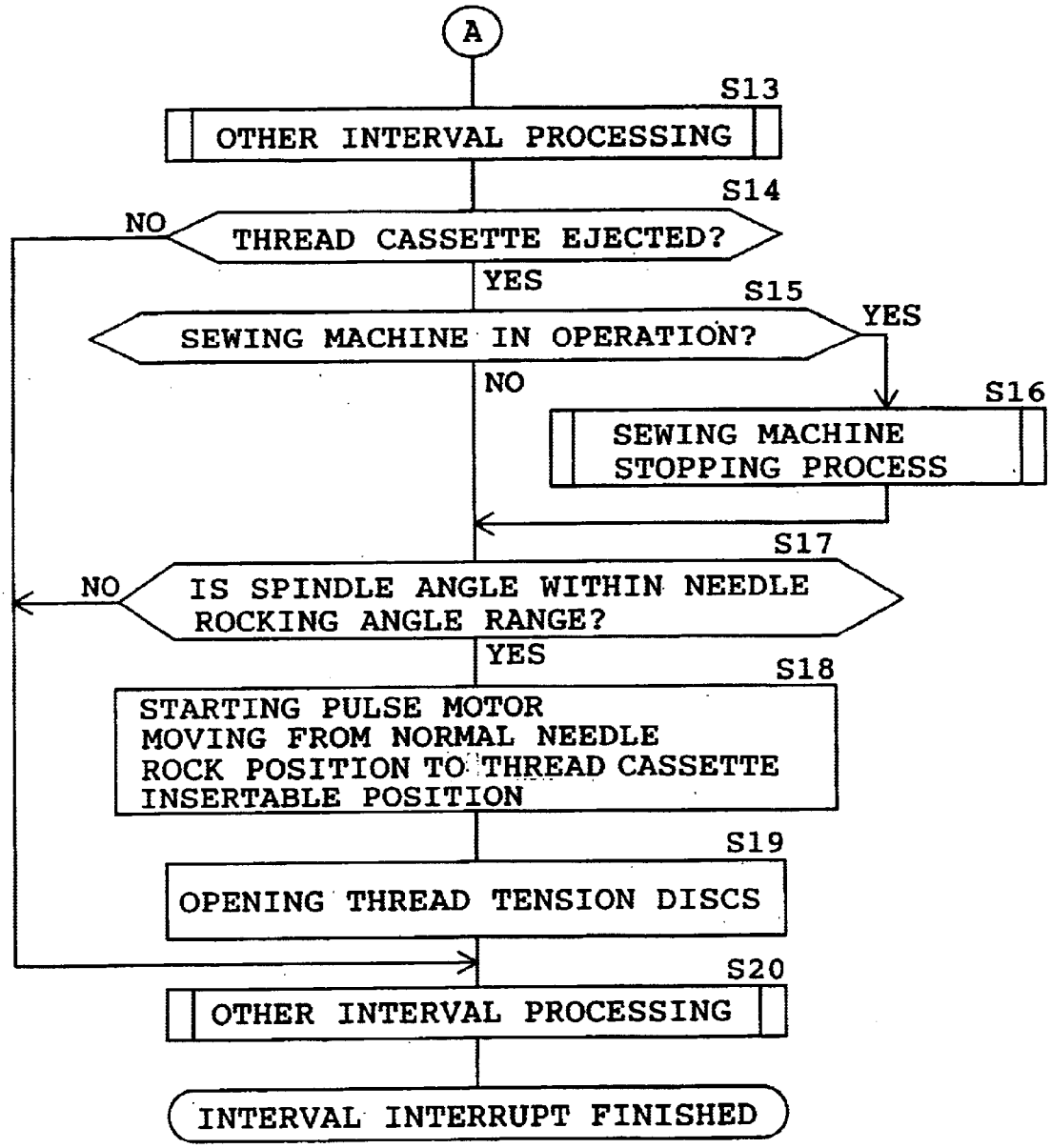
FIG. 20 is the second half of the flowchart showing the procedure of processing for attachment and detachment of the thread cassette carried out by the control device.

When the cassette detecting switch 102 is turned off after the other interval processing at step S13, the control device 100 determines that the thread cassette 10 has been ejected from the cassette mount 5 (YES at step S14), as shown in FIG. 20. The control device 100 then carries out a stopping process for the sewing machine motor 9 (step S16) to stop the needle bar up-down moving mechanism 18. In this case, the sewing machine motor 9 is stopped when the rotation angle of the spindle ranges from 20 to 50 degrees, for example, is at 45 degrees. The control device 100 advances to step S18 when the spindle angle is within the aforesaid zigzag angle range (YES at step S17).

The pulse motor 44 is driven at step S18 so that the cam member 13 is rotated to the position as shown in FIG. 12A, whereby the needle bar 12 is moved from the normal zigzag position to the thread cassette insertable position (the left needle position corresponding to the predetermined zigzag position). With this movement, the control device 100 opens the thread tension discs 41 and 42 at step S19 and thereafter carries out the other interval processing (S20), thereby ending the control. When determining in the negative at each of steps S14 and S17, the control device 100 advances to step S20.

According to the sewing machine M, when the ejection of the thread cassette 10 from the cassette mount 5 is detected by the cassette detecting switch 102, the needle bar 12 is controlled to be rocked to the predetermined zigzag position (the left needle position) where the needle 12 can be threaded by the threading mechanism 16B. More specifically, when the thread cassette 10 has been ejected from the cassette mount 5, the needle bar 12 is rocked to the predetermined zigzag position for subsequent attachment of the thread cassette 10. Consequently, when the thread cassette 10 is subsequently attached to the cassette mount 5, the thread 11 drawn from the thread cassette 10 can be passed through the needle hole 12*b* by the threading mechanism 16B easily and reliably. In the conventional apparatus, the needle bar needs to be rocked to the redetermined zigzag position in the attachment of the thread cassette. In he foregoing embodiment, however, the needle bar 12 is automatically rocked to the predetermined zigzag position when the thread cassette 10 has been ejected. Consequently, the inconvenience of rocking the needle bar to the predetermined zigzag position can be eliminated.

The needle bar 12 and the threading mechanism 16B are rocked integrally since the predetermined zigzag position is set relative to the thread feeding mechanism 16A. However, even when the thread feeding mechanism 16A is fixedly provided, the needle bar 12 (the needle 12*a*) and the threading and thread feeding mechanisms 16B and 16A can be located in 8 suitable positional relation in the attachment of the thread cassette 10, so that threading the needle 12*a* can reliably be carried out.

When ejection of the thread cassette 10 from the cassette mount 5 is detected by the cassette detecting switch 102 during operation of the needle bar up-down moving mechanism 18, the mechanism 18 is stopped and the needle bar 12 is stopped at the position which is near the needle top and at which the needle can be threaded. Consequently, any trouble due to continuous up-down movement of the needle bar 12 even after ejection of the thread cassette 10 can be prevented. Furthermore, the needle bar 12 can be re-rocked to the predetermined position for the subsequent attachment of the thread cassette after the needle bar has been stopped.

Furthermore, the needle bar 12 is stopped at the position (the spindle rotation angle ranges from 20 to 50 degrees) which is near the needle top and at which the needle can be threaded, on the basis of the results of detection by the spindle rotation angle detecting sensor 101. Accordingly, when the thread cassette 10 is subsequently attached to the cassette mount 5, the needle bar 12 is located at the position where the thread 11 can be passed through the needle hole by the threading mechanism 16B. Consequently, the thread drawn from the thread cassette 10 attached to the cassette mount 5 can be passed through the needle hole 12*b* by the threading mechanism 16B easily and reliably.

Furthermore, when ejection of the thread cassette 10 has been detected by the cassette detecting switch 102, the thread tensioning mechanism 14 is opened. Consequently, the thread cassette 10 can be ejected front the cassette mount 5 smoothly without the thread being caught by the thread tensioning mechanism 14.

When attachment of the thread cassette 10 to the cassette mount 5 has been detected by the cassette detecting switch 102, the needle bar 12 is rocked so as to occupy a sewing start position (neutral position), a predetermined period of time after attachment of the thread cassette 10 to the cassette mount 5 is detected by the detector. Consequently, the sewing operation can be started quickly. In this case, since the aforesaid predetermined period of time is set at 30 msec, the needle bar 12 can be moved to the sewing start position within a period of time as short as possible although it needs to be sufficiently long enough to carry out the threading operation by the threading mechanism. Moreover, the user can be prevented from suffering a sense of incongruity.

A single pulse motor 44 is used as a drive source for both tensioning mechanism 14 and needle bar rocking mechanism 19. Consequently, the construction of the sewing apparatus can be simplified as compared with the case where two drive sources are provided for the respective mechanisms.

Several modified forms will be described. The thread cassette of the embodiment is a mere example, The thread need not be wound on the spool. As another applicable thread cassette, a mass of thread serving as the thread source may be accommodated in the accommodating section. Furthermore, at least one of the walls surrounding the thread accommodating section may be eliminated so that the thread spool can be held on a holding portion of a spool pin.

A detecting switch may be provided for directly detecting operation of the ejection operating member 60. Detachment of the thread cassette 10 from the cassette mount 5 may indirectly be detected on the basis of the result of detection by the detecting switch The pulse motor 44 may not be an actuator common to the thread tensioning mechanism 14 and the needle bar rocking mechanism 19. These mechanisms 14 and 19 may be provided with individual actuators such as electric motors respectively, instead. In this construction, when the user has changed the setting of the thread tension, the actuator for the thread tensioning mechanism may be operated so that the changed thread tension is set. More specifically, the thread tension may be released in the ejection of the thread cassette using an actuator automatically changing the thread tension for the sewing. In this case, a solenoid actuator may be used to open the thread tension discs 41 and 42 of the thread tensioning mechanism 14. The solenoid actuator may directly push the thread tension disc 42 to open the discs 41 and 42. Furthermore, the thread tension discs 41 and 42 need not be completely opened. The thread tension may be reduced or reduced to a predetermined smaller value.

The predetermined zigzag position is not necessarily the left need position of the needle bar 12 but may be set at another position. In this case, however, it is needless to say that the locations of the thread feeding mechanism 16A and threading mechanism 16*b* and the like need to be set so that the thread 11 drawn from the thread cassette 10 can reliably be passed through the needle hole 12*b* by these mechanisms when the thread cassette 10 is attached to the cassette mount 5 with the needle bar 12 being located at the predetermined zigzag position.

The needle bar 12 is automatically moved to the predetermined zigzag position in the foregoing embodiment. However, the sewing machine M may be mechanically constructed and/or electrically arranged so that the user can decide whether the needle bar 12 can be moved and so that the needle bar is automatically moved to the predetermined zigzag position when the sewing machine has been supplied with input of permission for movement by the user.

The cassette attachment/detachment control program including the needle bar position control program, which is stored in ROM 100*b* of the control device 100, can be applied to sewing machines of the types similar to the sewing machine M. Accordingly, the cassette attachment/detachment control program or the needle bar position control program may be supplied to users via communication means such as an internet or with a recording medium such as CD, MD or FD.

In the foregoing embodiment, the sewing machine M is constructed so that the threading operation is carried out in parallel with the attaching operation in the course of attaching the thread cassette 10 to the cassette mount 5. However, the threading operation may be carried out separately after the thread cassette 10 has been attached to the cassette mount 5. Alternatively, the threading operation may be carried out before attachment of the thread cassette 10 is completed. More specifically, the threading mechanism 16B can only be constructed so as to pass the thread 11 through the needle hole.

In the foregoing embodiment, the thread feeding and threading mechanisms 16A and 16B and thread guiding mechanism 17 are linked to one another so that each mechanism performs its operation upon lowering of the thread cassette 10, regardless of supply of electric power to the sewing machine. More specifically, even when power is not supplied to the sewing machine, the threading can be carried out, only if the needle bar 12 is located at the predetermined zigzag position. Consequently, the needle bar 12 is moved to the predetermined zigzag position when the thread cassette 10 has been ejected from the cassette mount 5 during power supply. Thereafter, even when power is off, the threading can reliably be carried out at the time of subsequent attachment of the thread cassette 10.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A sewing apparatus comprising:

a needle bar;

a needle bar rocking mechanism for rocking the needle bar;

a thread cassette having a thread accommodating section for accommodating a thread;

a cassette mount to which the thread cassette is detachably attached;

a threading mechanism for passing the thread drawn from the thread cassette through a hole of a sewing needle mounted on the needle bar;

a detector for detecting the thread cassette ejected from the cassette mount; and a needle bar position control unit controlling the needle bar rocking mechanism so that the needle bar is rocked so as to occupy a predetermined zigzag position, when the detector has detected the thread cassette ejected from the cassette mount.

2. A sewing apparatus according to claim 1, further comprising a thread feeding mechanism catching the thread drawn from the thread cassette and carrying the thread near the needle hole when the thread cassette has been attached to the cassette mount, wherein the threading mechanism passes the thread having been carried by the thread feeding mechanism through the needle hole, and the predetermined zigzag position is set so as to correspond to a position of the thread feeding mechanism.

3. A sewing apparatus according to claim 1, further comprising:

a needle bar up-down movement mechanism moving the needle bar up and down; and a needle bar up-down movement stopping unit stopping the needle bar up-down movement mechanism when ejection of the thread cassette from the cassette mount is detected during operation of the needle bar up-down movement mechanism.

4. A sewing apparatus according to claim 1, further comprising:

a thread tensioning unit adjusting a tension of the thread drawn from the thread cassette attached to the cassette mount; and a thread tension control unit controlling the thread tensioning unit so that the thread tensioning unit is opened when ejection of the thread cassette from the cassette mount is detected by the detector during operation of the needle bar up-down movement mechanism.

5. A sewing apparatus according to claim 1, wherein the detector further detects the thread cassette having been attached to the cassette mount, and the needle bar position control unit controls the needle bar rocking mechanism so that the needle bar is rocked so as to occupy a sewing start position, a predetermined period of time after attachment of the thread cassette to the cassette mount is detected by the detector.

6. A sewing apparatus according to claim 5, wherein the predetermined period of time is 30 msec.

7. A sewing apparatus according to claim 4, wherein both the needle bar rocking mechanism and the thread tensioning unit are driven by a single pulse motor.

8. A sewing apparatus according to claim 3, further comprising a spindle driving the needle bar up-down movement mechanism and a spindle rotation angle detector detecting a rotation angle of the spindle, wherein the needle bar up-down movement stopping unit stops the needle bar up-down movement mechanism within a predetermined range of rotation angle so that the needle thread is stopped at an up-down position where the thread can be passed through the needle hole by the threading mechanism, based on a result of detection by the spindle rotation angle detecting unit.

9. A sewing apparatus according to claim 8, wherein the predetermined range of rotation angle is from 20 to 50 degrees.

10. A needle bar position control program for controlling a position of a needle bar in a sewing apparatus including a needle bar, a needle bar rocking mechanism for rocking the needle bar, a thread cassette having a thread accommodating section for accommodating a thread, a cassette mount to which the thread cassette is detachably attached, a threading mechanism for passing the thread drawn from the thread cassette through a hole of a sewing needle mounted on the needle bar, and a detector for detecting the thread cassette ejected from the cassette mount, the program accomplishing a function of controlling the needle bar rocking mechanism so that the needle bar is rocked so as to occupy a predetermined zigzag position, when the detector has detected the thread cassette ejected from the cassette mount.

* * * * *